US006595617B2

(12) United States Patent
Sharma et al.

(10) Patent No.: US 6,595,617 B2
(45) Date of Patent: Jul. 22, 2003

(54) SELF-CLEANING PRINTER AND PRINT HEAD AND METHOD FOR MANUFACTURING SAME

(75) Inventors: Ravi Sharma, Fairport, NY (US); Michael E. Meichle, Rochester, NY (US); Gilbert A. Hawkins, Mendon, NY (US); Omid Moghadam, Lake Oswego, OR (US); John A. Quenin, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/751,620

(22) Filed: Dec. 29, 2000

(65) Prior Publication Data

US 2002/0126174 A1 Sep. 12, 2002

(51) Int. Cl.[7] ..... B41J 2/165
(52) U.S. Cl. ..... 347/28
(58) Field of Search ..... 347/22, 28, 29, 347/30

(56) References Cited

U.S. PATENT DOCUMENTS

| | | | | |
|---|---|---|---|---|
| 4,591,870 A | | 5/1986 | Brau et al. | |
| 4,600,928 A | | 7/1986 | Braun et al. | |
| 4,970,535 A | | 11/1990 | Oswald et al. | |
| 5,559,536 A | | 9/1996 | Saito et al. | |
| 5,574,485 A | | 11/1996 | Anderson et al. | |
| 5,706,039 A | | 1/1998 | Chamberlain et al. | |
| 5,914,734 A | | 6/1999 | Rotering et al. | |
| 6,142,601 A | | 11/2000 | Sharma et al. | |
| 6,183,058 B1 | * | 2/2001 | Sharma et al. | 347/28 |

FOREIGN PATENT DOCUMENTS

| | | |
|---|---|---|
| DE | 3825045 | 9/1996 |
| EP | 1088665 | 4/2001 |
| JP | 58096563 | 6/1983 |
| JP | 59012857 | 1/1984 |

* cited by examiner

*Primary Examiner*—Huan Tran
(74) *Attorney, Agent, or Firm*—Roland R. Schindler, II

(57) ABSTRACT

The present invention comprises a self-cleaning print head having an orifice plate defining an ink jet orifice, cleaning orifice and drain orifice. The orifice plate further defines an outer surface between the orifices. The print head has a source of pressurized cleaning fluid connected to the cleaning orifice and a fluid return connected to the drain orifice for storing used cleaning fluid. During cleaning operations, the source of pressurized cleaning fluid causes cleaning fluid to flow from the cleaning orifice, and the cleaning orifice directs the flow of cleaning fluid across the outer surface and the ink jet orifice and into the drain orifice.

24 Claims, 17 Drawing Sheets

SELF-CLEANING PRINTER AND PRINT HEAD AND METHOD FOR MANUFACTURING SAME

CROSS-REFERENCE TO RELATED APPLICATION(S)

Reference is made to commonly assigned copending U.S. patent application Ser. No., filed herewith, entitled A SELF-CLEANING INK JET PRINTER AND PRINT HEAD WITH CLEANING FLUID FLOW SYSTEM, by Sharma et al.; Ser. No. 09/407,451, filed Sep. 28, 1999, entitled A SELF-CLEANING INK JET PRINTER SYSTEM WITH REVERSE FLUID FLOW AND METHOD OF ASSEMBLING THE PRINTER SYSTEM, by Sharma et al., and Ser. No., filed herewith, entitled INK JET PRINT HEAD WITH CAPILLARY FLOW CLEANING, by Sharma et al.

FIELD OF THE INVENTION

This invention relates to a self-cleaning printer and a self-cleaning print head.

BACKGROUND OF THE INVENTION

Ink jet printers produce images on a receiver by ejecting ink droplets onto the receiver in an imagewise fashion. The advantages of non-impact, low-noise, low energy use, and low cost operation in addition to the capability of the printer to print on a receiver medium such as a plain paper are largely responsible for the wide acceptance of ink jet printers in the marketplace.

Many types of ink jet printers have been developed. One form of ink jet printer is the "continuous" ink jet printer. Continuous ink jet printers generate stream of ink droplets during printing. Certain droplets are permitted to strike a receiver medium while other droplets are diverted. In this way, the continuous ink jet printer can controllably define a flow of ink droplets onto the receiver medium to form an image. One type of continuous ink jet printer uses electrostatic charging tunnels that are placed close to the stream of ink droplets. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the receiver.

Another type of ink jet printer is the "on demand" ink jet printer. "On demand" ink jet printers eject ink droplets only when needed to form the image. In one form of "on demand" ink jet printer, a plurality of ink jet nozzle is provided and a pressurization actuator is provided for every nozzle. The pressurization actuators are used to produce the ink jet droplets. In this regard, either one of two types of actuators are commonly used: heat actuators and piezoelectric actuators. With respect to heat actuators, a heater is disposed in the ink jet nozzle and heats the ink. This causes a quantity of the ink to phase change into a gaseous bubble and raise the internal ink pressure sufficiently for an ink droplet to be expelled onto the recording medium.

With respect to piezoelectric actuators, a piezoelectric material is provided for every nozzle. The piezoelectric material possesses piezoelectric properties such an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate.

When these materials are used in an ink jet print head, they apply mechanical stress upon the ink in the print head to cause an ink droplet to be ejected from the print head.

Inks for high speed ink jet printers, whether of the "continuous" or "on demand" type, must have a number of special characteristics. For example, the inks should incorporate a nondrying characteristic, so that drying of ink in the ink ejection chamber is hindered or slowed to such a state that by occasional "spitting" of ink droplets, the cavities and corresponding orifices are kept open.

Moreover, the ink jet print head is exposed to the environment where the ink jet printing occurs. Thus, the previously mentioned orifices and print head surface are exposed to many kinds of airborne particulates. Particulate debris may accumulate on the print head surface surrounding the orifices and may accumulate in the orifices and chambers themselves. Also, ink may combine with such particulate debris to form an interference burr that blocks the orifice or that alters surface wetting to inhibit proper formation of the ink droplet. Of course, the particulate debris should be cleaned from the surface and orifice to restore proper droplet formation.

Ink jet print head cleaners are known. An ink jet print head cleaner is disclosed in U.S. Pat. No. 4,970,535 titled "In Jet Print Head Face Cleaner" issued Nov. 13, 1990 in the name of James C. Oswald an ink jet print head face cleaner that provides a controlled air passageway through an enclosure formed against the print head face. Air is directed through an inlet into a cavity in the enclosure. The air that enters the cavity is directed past ink jet apertures on the head face and out an outlet. A vacuum source is attached to the outlet to create a sub-atmospheric pressure in the cavity. A collection chamber and removable drawer are positioned below the outlet to facilitate disposal of removed ink. However, the use of heated air is not a particularly effective medium for removing dried particles from the print head surface. Also, the use of heated air may damage fragile electronic circuitry that may be present on the print head surface.

Cleaning systems that use a cleaning fluid such as an alcohol or other solvent have been found to be particularly effective when used to clean print heads. This is because the solvent helps to dissolve the ink and other contaminants that have dried to the surface of the print head. One way to use a cleaning fluid to clean a print head is known as wet wiping. In wet wiping, a cleaning fluid is applied to the print head and a wiper is used to clean the cleaning fluid and contaminants from the print head. Examples of various wet wiping embodiments are found in U.S. Pat. No. 5,914,734 by Rotering et al. Each of these embodiments uses a cleaning station to apply a metered amount of cleaning fluid to the print head and to wipe cleaning fluid and contaminants from the print head. However, wipers can damage the fragile electronic circuitry and Micro Electro-Mechanical Systems (MEMS) that may be present on the print head surface. Further, the wiper itself may leave contaminants on the surface of the print head that can obstruct the orifices.

Another ink jet print head cleaner is disclosed in commonly assigned U.S. Pat. No. 4,600,928 by Braun et al. Braun et al. shows a continuous ink jet printing apparatus having an ultrasonic print head cleaning system. During cleaning, the print head is moved to a cleaning area and a cleaning station is fixed to the print head. Once that the print head is so positioned, a meniscus of ink is supported proximate to the ink droplet orifices, a charge plate and/or an ink catcher surface. Cleaning is then accomplished by ultrasonically vibrating the meniscus. This cleaning can be enhanced by providing a fluid pressure differential in the meniscus to cause the meniscus to enter into orifices to be cleaned and to be released from the orifices. Once that the cleaning operation is completed, ink from the print head is ejected into a sump in the cleaning station.

U.S. Pat. No. 5,574,485 by Anderson et al. describes a cleaning station having a jet to define a flow of a cleaning fluid at the print head forming a meniscus bridge between the print head and the jet. Anderson teaches that the print head can be cleaned by agitating the meniscus bridge by use of an ultrasonic vibrator and removing the fluid by way of a pair of vacuum sources disposed on the cleaning station and flanking the jet.

In each of these patents, a cleaning station is needed to provide the cleaning action that cleans the print head. Such cleaning stations increase the weight, complexity and size of a self-cleaning printer.

It is, therefore, another object of the present invention to provide a self-cleaning printer and a self-cleaning print head that do not require a cleaning station to provide the cleaning action that cleans the print head.

It is a further object of this invention to provide a self-cleaning printer and self-cleaning print head that use a flow of a cleaning fluid to clean the surface of a print head.

SUMMARY OF THE INVENTION

The present invention comprises a self-cleaning printer having an orifice plate defining an ink jet orifice, a cleaning orifice and drain orifice. The orifice plate further defines an outer surface between the orifices. A source of pressurized cleaning fluid connected to the cleaning orifice and a fluid return is connected to the drain orifice. During cleaning operations, the source of pressurized cleaning fluid causes cleaning fluid to flow from the cleaning orifice, and the cleaning orifice directs the flow of cleaning fluid across the outer surface and the ink jet orifice and into the drain orifice.

The present invention also comprises a self-cleaning print head, comprising print head having an orifice plate defining an ink jet orifice, a cleaning orifice and a drain orifice. The orifice plate further defines an outer surface between the orifices. A supply of pressurized cleaning fluid is connected to the cleaning orifice and a fluid return is connected to the drain orifice. During cleaning operations, the source of pressurized cleaning fluid causes cleaning fluid to flow from the cleaning orifice, and the cleaning orifice directs the flow of cleaning fluid across said outer surface and the ink jet orifice and into the drain orifice.

In certain embodiments of the present invention, flow guides are defined on the surface of the print head. A cleaning member is also provided. In certain embodiments, the cleaning member comprises a splash guard that engages flow guides on the surface of the print head.

BRIEF DESCRIPTION OF THE DRAWINGS

While the specification concludes with claims particularly pointing out and distinctly claiming the subject matter of the present invention, it is believed that the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
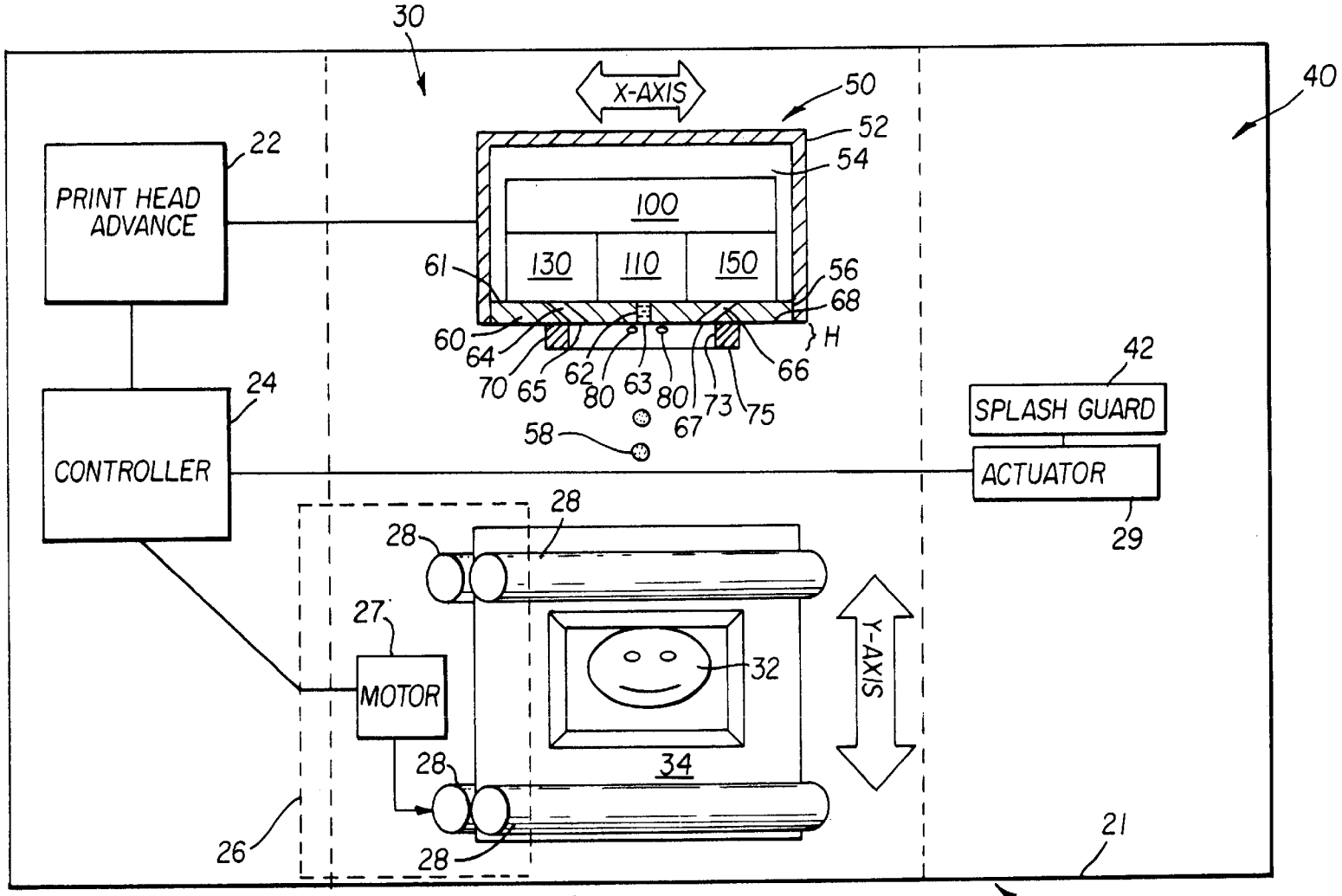
FIG. 1 shows a first embodiment of the self-cleaning printer of the present invention wherein the printer is operated in a printing mode.

FIG. 1 shows a first embodiment of the self-cleaning printer of the present invention generally referred to as 20. Printer 20 prints an image 32 on a media 34, which may be a reflective-type receiver (e.g. paper) or a transmissive-type receiver (e.g. transparency). Printer 20 comprises a cabinet 21 containing a print head 50 disposed adjacent to media 34. As is shown in FIG. 1, Y-axis displacement of media 34 relative to print head 50 is provided by media advance 26. The media advance 26 can comprise any number of well-known systems for moving media 34 within a printer 20, including a motor 27 driving pinch rollers 28, a motorized platen roller (not shown) or other well-known systems for paper and media movement. A print head advance 22 is fixed to print head 50 and translates print head 50 along an X-axis relative to media 34. Print head advance 22 can comprise any of a number of systems for moving print head 50 relative to a media 34 including among others a motorized belt arrangement (not shown) and a screw driven arrangement (not shown).

Controller 24 controls the operation of the print head advance 22 and media advance 26 and, thereby, can position the print head 50 at any X-Y coordinate relative to the media 34 for printing. For this purpose, controller 24 may be a model "CompuMotor" controller available from Parker Hannifin, Incorporated located in Rohrnert Park, Calif.

Print head 50 comprises print head body 52. Print head body 52 can comprise any of a box, housing, closed frame, or continuous surface or any other enclosure defining an interior chamber 54. A fluid flow system 100 is preferably defined within interior chamber 54. The print head body 52 can be fixed to the media advance 26 for motion with the media advance 26. The media advance 26 can also define a holder (not shown) that moves with the media advance 26 and is shaped to receive and hold the print head body 52. It will be recognized that the print head body 52 can be defined in many shapes and sizes and that the shape and size of the print head body 52 will be defined by the space and functional requirements of the printer 20 into which the print head 50 is installed.

An orifice plate 60 is provided. Orifice plate 60 can be formed from a surface on the print head body 52. Alternatively, in the embodiment shown in FIGS. 1 and 2, print head body 52 defines an opening 56 into which orifice plate 60 is fixed. Orifice plate 60 can be made of a thin and flexible material such as nickel. Where such a flexible orifice plate 60 is used, a structural member (not shown) is provided to support the orifice plate 60. Alternatively, orifice plate 60 can be made of a rigid material such as a silicon, a polymer or like material.

The orifice plate 60 defines an outer surface 68 and a fluid containment surface 61. When orifice plate 60 is fixed in opening 56, an outer surface 68 is directed toward media 34 while fluid containment surface 61 is directed toward interior chamber 54. Three passageways are defined between the fluid containment surface 61 and outer surface 68: an ink jet passageway 62 defining an ink jet orifice 63, a cleaning fluid passageway 64 defining a cleaning orifice 65 and a drain passageway 66 defining a drain orifice 67.

In the embodiment of FIG. 1, cleaning orifice 65 and drain orifice 67 are disposed on opposite sides of ink jet orifice 63. Cleaning orifice 65 is shaped to direct a flow of a cleaning fluid across outer surface 68 and ink jet orifice 63. In one embodiment, the radius of curvature between cleaning orifice 65 and outer surface 68 is defined in an asymmetric manner to direct the flow of cleaning fluid across outer surface 68, ink jet orifice 63 and into drain orifice 67. Drain orifice 67 is shaped to receive the cleaning fluid flow directed from cleaning orifice 65. In one embodiment, the radius of curvature between the outer surface 68 and the drain orifice 67 can be on the order of 10 microns.

Optional flow guide 70 is provided on outer surface 68 of orifice plate 60 and shown in partial cross section in FIG. 1. Flow guide 70 is defined adjacent to the flow of fluid across outer surface 68 and projects away from surface 68 to form a barrier that ensures that the flow fluid along outer surface 68 is not diverted away from drain orifice 67. The height (H) of flow guide 70 relative to outer surface 68 can be defined as a function of the expected maximum flow height of the flow of cleaning fluid. For example only, and not by way of limitation, height (H) may be approximately 3 to 30 thousandths of an inch.

Flow guide 70 can be integrally formed as a part of orifice plate 60 using one of many machining techniques. Flow guide 70 can be a simple barrier or it can be a hydrophobic or hydrophilic coating, etching, or ruled engraving, as dictated by the rheology of the cleaning fluid. Flow guide 70 can be formed from rigid material or it may be material formed from a resilient material such as an elastomer. Flow guide 70 can also be separately provided and mechanically attached to outer surface 68 by means of a fastener or adhesive. In the embodiment of FIG. 1, flow guide 70 takes the form of a rubberized seal that surrounds cleaning orifice 65, ink jet orifice 63 and drain orifice 67 as shown.

In a preferred embodiment, flow guide 70 has a wall surface 73 with a top surface 75. The wall surface 73 has hydrophilic properties, while the top surface 75 has hydrophobic properties. The radius of curvature between the wall surface 73 and the top surface 75 is preferably less than 0.1 microns. In this way a meniscus of fluid within the flow guide will be better contained by the flow guide 70.

Fluid flow system 100 comprises a supply of pressurized ink 110, a supply of pressurized cleaning fluid 130, and a fluid return 150. Fluid connections are defined between supply 110 and ink jet passageway 62, between supply 130 and cleaning fluid passageway 64 and between the fluid return 150 and drain fluid passageway 66. During normal printing operations, fluid flow system 100 causes controlled amounts of ink 114 to flow to the ink jet orifice 63 and form droplets 58. Images 32 are formed on the media 34 by depositing ink droplets 58 on the media 32 in particular concentrations at particular X-Y coordinates.

It has been observed that during printing operations, outer surface 68 may become fouled by contaminant 80. Contaminant 80 may be, for example, an oily film or particulate matter residing on outer surface 68. The particulate matter may be particles of dirt, dust, metal and/or encrustations of dried ink, or the like. The oily film may be grease, or the like. In this regard, contaminant 80 may partially or completely obstruct ink jet orifice 62. The presence of contaminant 80 is undesirable because when contaminant 80 completely obstructs orifice 63 ink droplets 58 cannot exit orifice 63. Also, when contaminant 80 partially obstructs orifice 63, ink droplets 58 may be deposited at an incorrect or unintended X-Y coordinate on the media 32. In this manner, such complete or partial obstruction of orifice 63 leads to unwanted printing artifacts such as "banding", a highly undesirable result. Also, the presence of contaminant 80 may alter surface wetting and inhibit proper formation of droplets 58 on surface 68 near orifice 63 thereby leading to such printing artifacts. Therefore, it is desirable to clean (i.e., remove) contaminant 80 to avoid printing artifacts.

Figure 2:
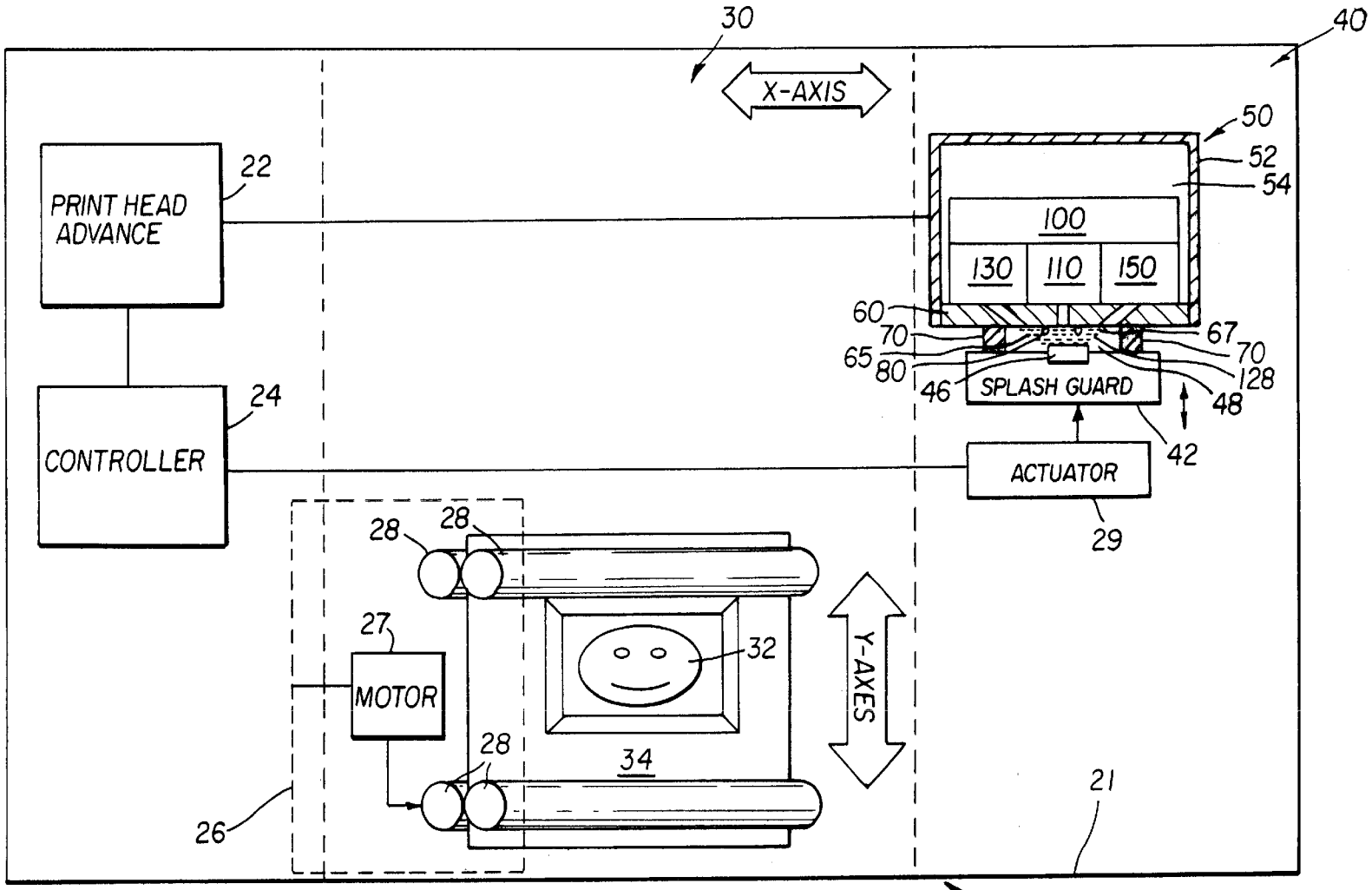
FIG. 2 shows the embodiment of FIG. 1, wherein the self-cleaning printer is operated in a self-cleaning mode.

FIG. 2 shows a diagram of the printer 20 operated to clean contaminant 80 from the surface 68 and ink jet orifice 63. When the controller 24 initiates a cleaning operation, the print head 50 is moved into a cleaning area 40 defined along the X-axis but separated from printing area 30. Located within cleaning area 40 is an optional splash guard 42. When the print head 50 is positioned into the cleaning area 40, controller 24 causes actuator 29 to advance splash guard 42 into sealing engagement with flow guide 70 of print head 50. This forms a sealed gap 48 that contains ink jet orifice 63, cleaning orifice 65 and drain orifice 67.

When a seal is formed between flow guide 70 and splash guard 42, cleaning action is initiated by controller 24. Controller 24 directs fluid flow system 100 to eject a flow 128 of cleaning fluid 134 from cleaning orifice 65 and to draw cleaning fluid 134 into drain orifice 67. The flow 128 of cleaning fluid 134 across print surface 68 and ink jet orifice 62 removes unwanted contaminant 80 from surface 68 and ink jet orifice 62. The splash guard 42 prevents cleaning fluid 134 from being deflected away from surface 68 by contaminant 80 during cleaning and into printer 20 where it could damage the media 34, the controller 24 or other components of printer 20.

The cleaning fluid 134 may be any suitable liquid solvent composition, such as water, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the liquid. In certain embodiments of the present invention, ink can be used as a cleaning fluid.

An optional ultrasonic transducer 46 is shown in FIG. 2. This transducer 46 is fixed to splash guard 42 and serves to ultrasonically excite the flow 128 of cleaning fluid 134 as it passes from cleaning orifice 65 to drain orifice 67. The ultrasonic excitation helps to dislodge contaminant 80 from surface 68 and ink jet orifice 63.

It will be understood that because splash guard 42 contacts only flow guide 70, it is not necessary to provide mechanisms to precisely align of splash guard 42 with flow guide 70 or orifices 63, 65 and 67. Further, it will be understood, that splash guard 42 can comprise, among other things, a fabric sheet, foam, elastomer, plastic plate or block or a metal plate or block. In a preferred embodiment, splash guard 42 comprises an elastomeric material that conforms to the shape of flow guide 70 and, therefore more easily forms a seal with flow guide 70. In this respect, it will also be understood that splash guard 42 can be positioned at any location along the X-axis of travel of print head 50 and can even move with print head 50 to reduce the overall size of the printer 20 and to eliminate the time required to traverse print head 50 to cleaning area 40. It will also be understood that while splash guard 42 is shown in connection with the printer 20 of the present invention, the cleaning fluid control features of print head 50 can be used without splash guard 42.

Fluid Flow System

Figure 3:
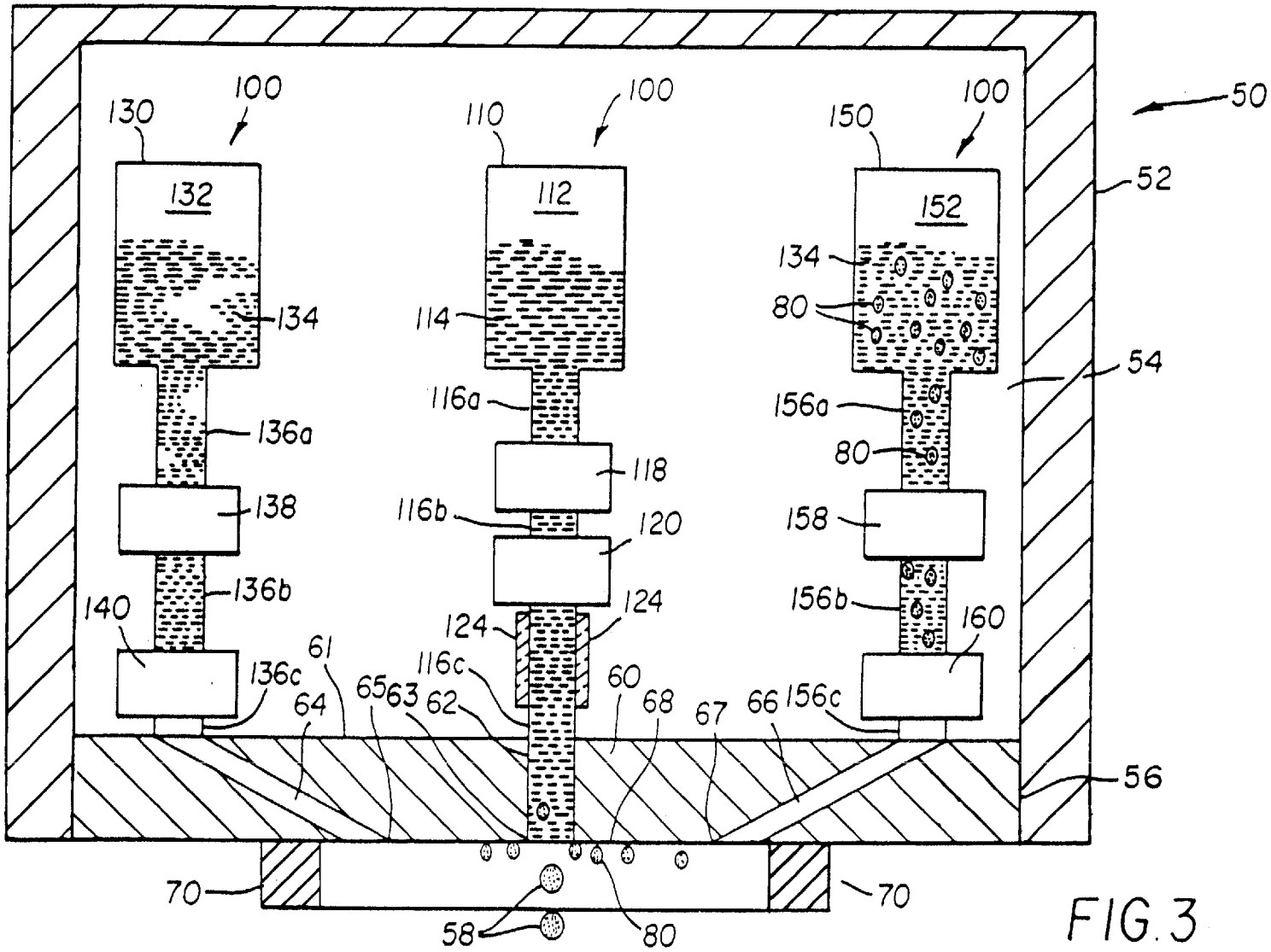
FIG. 3 shows a partial cross-section of the self-cleaning print head of the present invention with the fluid flow system shown in greater detail, and operating in a printing mod.

Turning now to FIG. 3, what is shown is a partial cross-section of self-cleaning print head 50 of the present invention, with one embodiment of fluid flow system 100 shown in greater detail. As is shown in FIG. 3 and described herein, fluid flow system 100 is contained within the print head 50. However, it will be appreciated that elements of the fluid flow system 100 can be provided by structures that are external to the print head 50 and that cleaning fluid 134, and ink 114 can be conveyed to and from print head 50 by means of hoses (not shown) or other like members. Print head 50 comprises a print head body 52, defining a cavity 54 having an open end 56. Print head 50 also comprises an orifice plate 60, as described above, in open end 56.

In the embodiment of FIG. 3, pressurized ink source 110 is contained within the cavity 54 and comprises a reservoir 112 containing ink 114, an ink pump 118, and an ink valve 120. An ink fluid flow path 116*a* connects ink reservoir 112 to the ink pump 118. Ink fluid flow path 116*b* connects ink pump 118 to ink valve 120. Ink fluid flow path 116*c* joins ink valve 120 to ink jet passageway 62. During printing operations, ink 114 is drawn from the reservoir 112 by action of pump 118. Pressurized ink 114 from the pump 118 is then advanced down the ink fluid flow path 116*b* to the ink valve 120. During printing operations the ink valve 120 is maintained in open position allowing ink 114 to pass through the ink valve 120. To print image 32 on media 34, ink droplets 58 are released from ink jet orifice 62 in the direction of media 28, so that droplets 58 are intercepted by media 34.

To generate the ink droplets 58, at least one segment of the ink fluid flow path 116, for example 116*c*, is formed of a piezoelectric material, such as lead zirconium titanate (PZT). Such a piezoelectric material is mechanically responsive to electrical stimuli so that side walls 124 simultaneously inwardly deform when electrically stimulated. When sidewalls 124 simultaneously inwardly deform, the volume of ink fluid flow path 116*c* decreases to squeeze ink droplets 58 from ink jet orifice 63. Ink droplets 58 are preferably ejected along an axis normal to orifice 63.

Pressurized supply of cleaning fluid, 130 comprises a cleaning fluid reservoir 132 containing a supply of cleaning fluid 134, a cleaning fluid pump 138 and a cleaning fluid valve 140. Cleaning fluid reservoir 132 and the cleaning fluid pump 138 are joined by cleaning fluid flow path 136*a*. Cleaning fluid pump 138 and cleaning fluid valve 140 are joined by cleaning fluid flow path 136*b*. Cleaning fluid valve 140 is, in turn, joined to cleaning fluid passageway 64 by cleaning fluid flow path 136*c*.

Fluid return 150 comprises drain reservoir 152 containing a cleaning fluid 132 and contaminant 80, a drain fluid pump 158 and a cleaning fluid valve 160. Drain fluid reservoir 152 and drain fluid pump 158 are joined by drain fluid flow path 156*a*. Drain fluid pump 158 and the drain fluid valve 160 are joined by drain fluid flow path 156*b*. Drain fluid valve 160 is, in turn, joined to drain fluid passageway 66 by drain fluid flow path 156*c*. During printing operations, cleaning fluid valve 140 and drain fluid valve 160 are closed.

Figure 4:
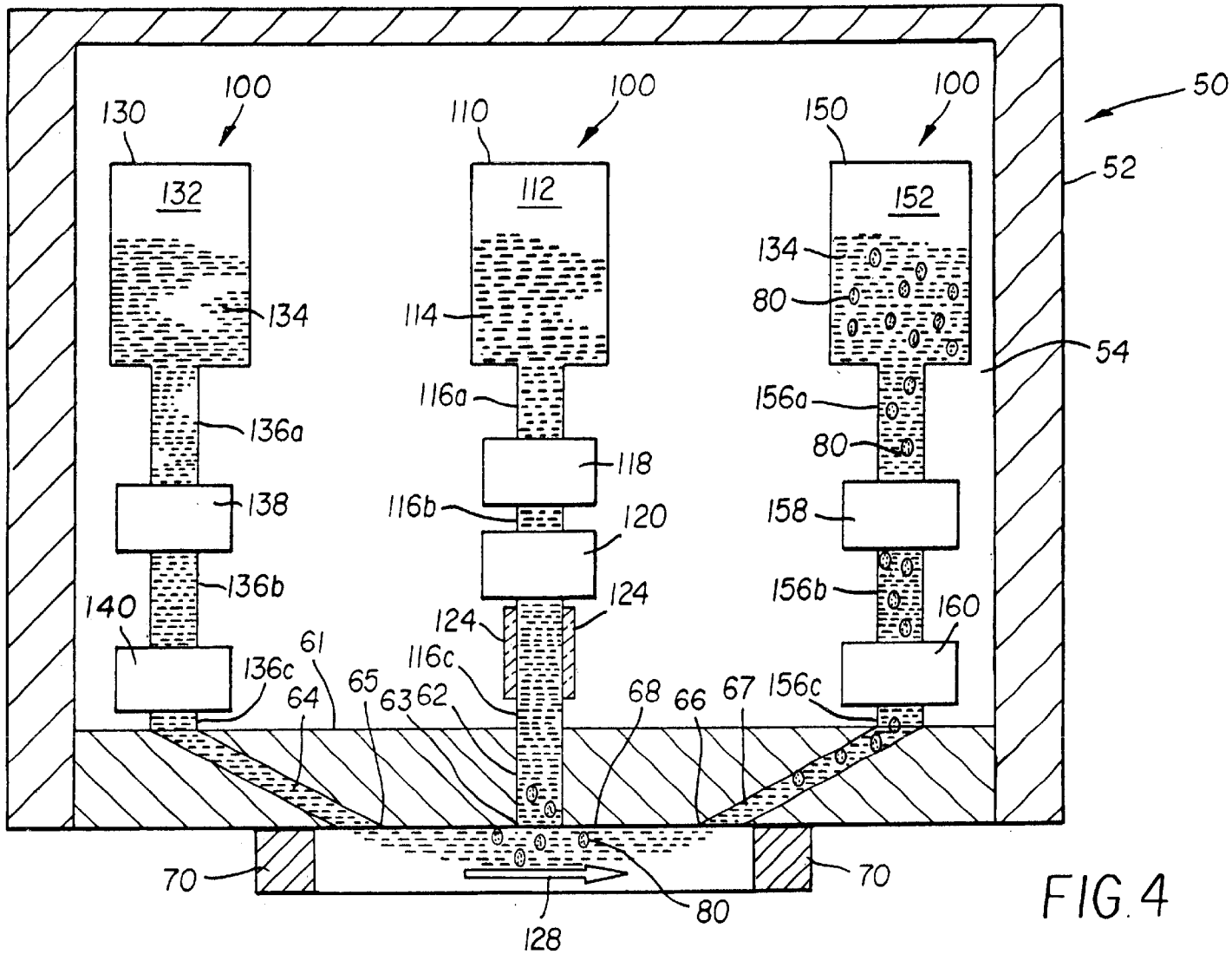
FIG. 4 shows a partial cross-sectional view of an embodiment of the print head of the present invention with the fluid flow system shown in greater detail and operated in a cleaning mode.

FIG. 4 shows print head 50 of the present invention in partial cross section during a self-cleaning operation. During cleaning operations, pump 138 is activated. This draws cleaning fluid 134 from the cleaning fluid reservoir 132. Pump 138 pressurizes cleaning fluid 134 to create a flow 128 of cleaning fluid 134 in fluid flow path 136*b*. Valve 140 is opened permitting the pressurized flow of cleaning fluid into cleaning fluid flow path 136*c* and into cleaning fluid passageway 64. This flow 128 of cleaning fluid 134 flows across outer surface 68 and orifice 63. The flow 128 is guided by flow guide 70 toward drain orifice 67. At substantially the same time, fluid drain pump 158 is turned on and valve 160 is opened. Pump 158 defines a negative pressure in drain fluid flow path 156*b*, drain fluid flow path, 156*c*, drain flow path 66, drain orifice 67, and across outer surface 68 and orifice 63. This negative pressure draws cleaning fluid 134, ink 114, and contaminant 80 into the drain orifice 67 and away from surface 68. Cleaning fluid 134, ink 114, and contaminant 80 are then pumped into reservoir 152 by way of drain fluid flow path 156*a*.

According to the embodiment of the present invention shown in FIG. 4, the flow 128 of cleaning fluid 132 across ink jet orifice 63 is defined so as to cause a flow 128 of cleaning fluid 132 to enter ink jet passageway 62 in order to remove any ink 114 or contaminant 80 from ink jet passageway 62, ink jet orifice 63, or the ink fluid flow path 116(*b*) or 116(*c*). In this regard, a negative pressure can be induced to attract cleaning fluid into the ink jet orifice 63 by action of the piezoelectric sidewalls 124 of ink fluid flow path 116*b,* or by an optional second cleaning fluid pump (not shown) connected to the ink fluid flow path 116(*b*), or 116(*c*).

In FIG. 4, ink jet valve 120 is shown closed, blocking the flow of ink 114 during the cleaning process. However, it will be understood that a flow of ink 114 can be defined concurrently with the flow 128 of cleaning fluid 134 to facilitate cleaning of the ink jet orifice 63 and ink jet passageway 62. In this manner, it is not necessary to cause cleaning fluid to flow into the ink jet orifice 63.

The manner in which the flow 128 of cleaning fluid 134 across surface 68 and orifice 63 is defined is a function of the pressure provided by pump 134, the shape of cleaning orifice 65, the geometric alignment of cleaning orifice 65, the material used on surface 68 of orifice plate 60, the physical characteristics of cleaning fluid 134, and the negative pressure supplied by drain pump 158. In a preferred embodiment of the present invention, turbulence is induced in flow 128 of cleaning fluid 134 to enhance the cleaning capabilities of fluid 134.

Figure 5:
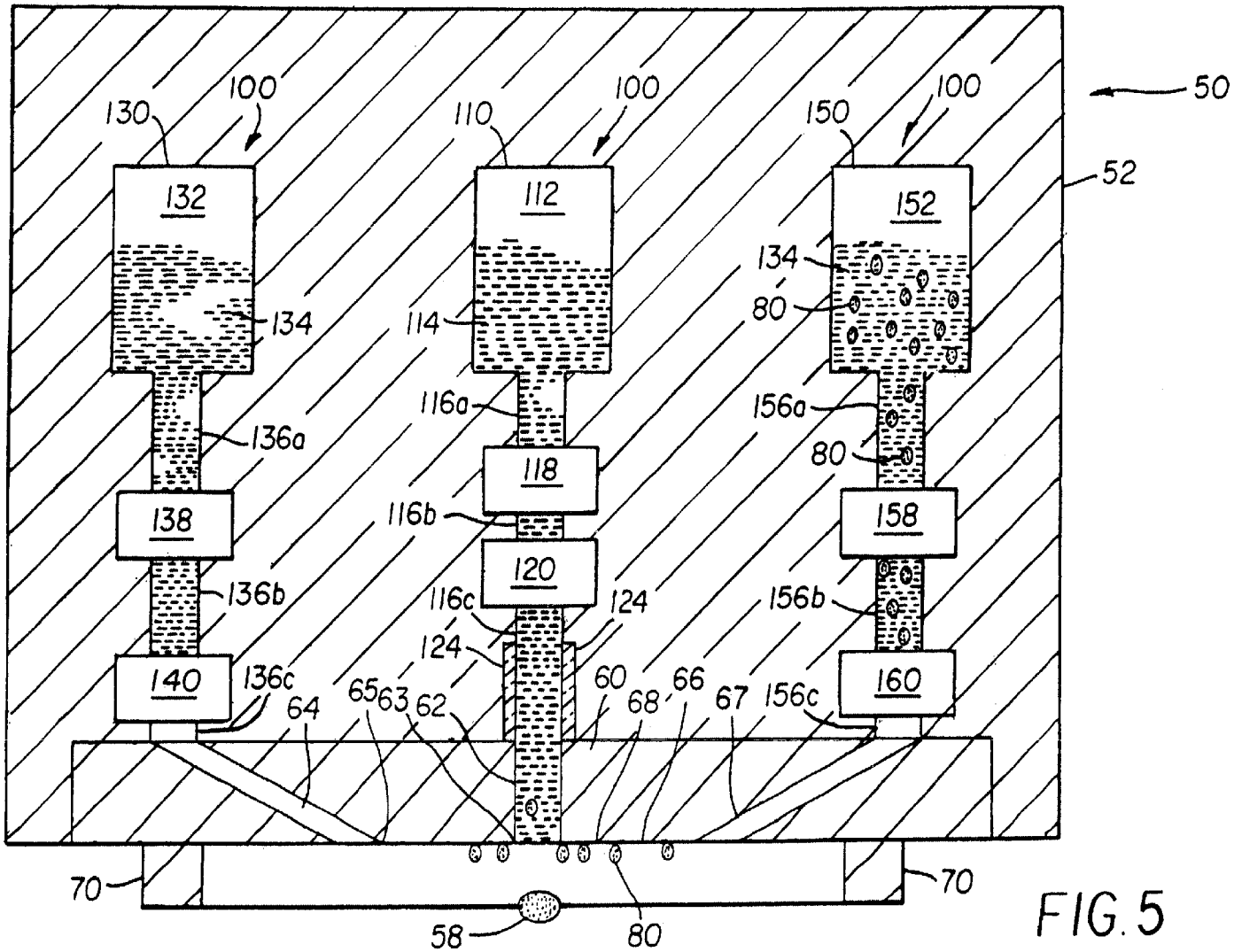
FIG. 5 shows an embodiment of the present invention wherein the print head body comprises a single structure defining the orifice plate, the ink jet orifice, the cleaning orifice, the drain orifice, and the fluid flow path.

FIG. 5 shows the print head 50 of the present invention wherein the print body 54 comprises a single structure defining the orifice plate 60, fluid flow guides 70 and portions of the fluid flow system 100 including, but not limited to, ink fluid reservoir 112; ink fluid flow path 116*a,* 116*b* and 116*c;* cleaning fluid reservoir 132; cleaning fluid flow path 136; and cleaning fluid flow path 136*a,* 136*b* and 136*c;* drain fluid reservoir 152, drain fluid flow path 156*a,* 156*b,* and 156*c,* and passageways 62, 64, 66 and orifices 63, 65, and 67.

It will be understood that in the embodiments of FIGS. 3, 4 and 5, the cleaning fluid reservoir 132 and ink reservoir 172 can be pressurized eliminating the need for an ink jet pump 118 and cleaning fluid pump 138.

In certain embodiments, valves 120, 140, 160, and pumps 138, 118, and 158, can also be integrally formed as part of print head body 52. Print head body 52 can be formed, at least in part, from piezoelectric materials to define ink or fluid ejection pumps 118, 138 and 158, valves 120, 140 and 160. An orifice plate 60, as described above, can be integrally formed from print head body 52, or alternatively, print head body 52 can define an area 57 to engage orifice plate 60. Fluidic connections are defined between the source of pressurized ink 110 and the ink jet orifice 63, between the source of pressurized cleaning fluid 130 and the cleaning orifice, and between the fluid return 150 and the drain orifice 67.

In the embodiment shown in FIG. 5, the source of pressurized ink 110, the source of pressurized cleaning fluid 130 and the fluid return 150, are shown as having the same structural elements as are shown in FIG. 4. However, it will be understood that other structures can be used and can be integrally formed in the print head body 52.

Figure 6:
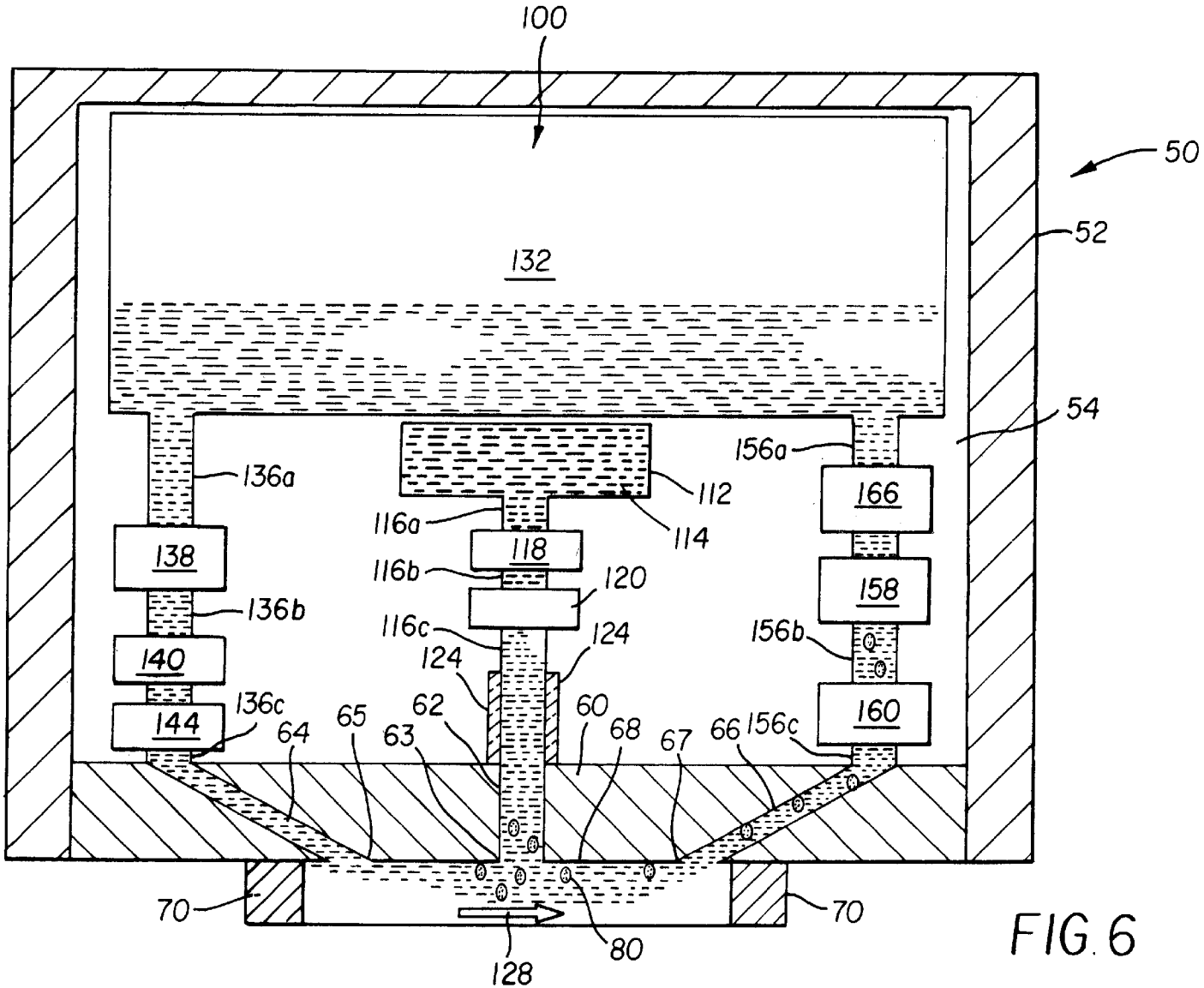
FIG. 6 shows an embodiment of the print head of the present invention having a common cleaning fluid reservoir connected to the cleaning fluid flow path and the drain flow path.

Referring now to FIG. 6, there is shown, in partial cross-section, an alternative embodiment of the print head 50 of the present invention wherein the fluid flow system 100 filters and re-circulates cleaning fluid 134. In this embodiment a single cleaning fluid reservoir 132 is provided. Reservoir 132 is connected to a cleaning fluid flow path 136*a* that is joined to cleaning fluid pump 138. Cleaning fluid pump 138 is joined to cleaning fluid valve 140 by cleaning fluid flow path 136*b*. Cleaning fluid valve 140 is, in turn, joined to cleaning fluid passageway 64 by cleaning fluid flow path 136*c*. During cleaning operations, a flow 128 of cleaning fluid 134 is generated from the cleaning orifice 65 in the manner generally described above.

In the embodiment shown in FIG. 6, the flow 128 of cleaning fluid 134 passes across outer surface 68 and orifice 62, cleans outer surface 68 and ink jet orifice 62 of contaminant 80 and enters drain orifice 67. In the embodiment shown in FIG. 6, cleaning fluid 132 and contaminant 80 are pumped from drain orifice 67, and forced through a filter 166 which passes the cleaning fluid 134 into the cleaning fluid reservoir 132 while trapping contaminant 80. Also shown in FIG. 6, an ultrasonic transducer 144 is connected to cleaning fluid flow path 136*c*. Ultrasonic transducer 144 excites flow 128 of cleaning fluid 134 to enhance the cleaning capabilities of the flow 128 of cleaning fluid 134.

Figure 7:
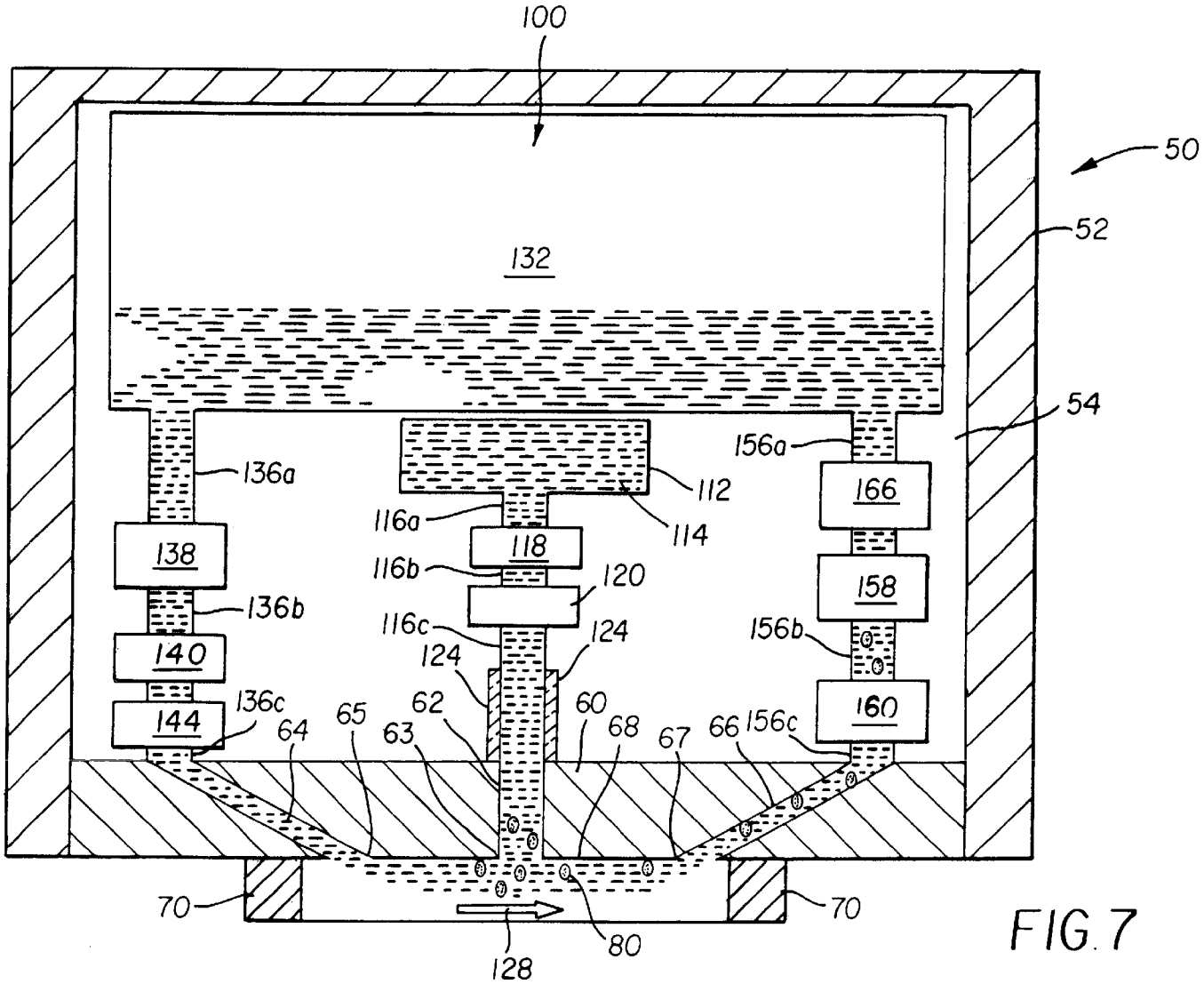
FIG. 7 shows an embodiment of the print head of the embodiment of FIG. 6 wherein ink is used as a cleaning fluid.

As is shown in FIG. 7, ink 114 may be used as a cleaning fluid. In this embodiment, a single ink reservoir 112 may supply fluid both to the ink pump 118 and the cleaning fluid pump 138. It will also be understood, that, generally, with respect to any embodiment shown herein, ink 112 may also be used as a cleaning fluid 134.

Cleaning Fluid Flow Control Features

In practice, the arrangement of the cleaning orifice 65, the drain orifice 67, the flow guides 70 and the ink jet orifice 63 may be as complex or simple as necessary to provide a flow 128 of the cleaning fluid 134 across the ink jet orifice 63 and the surface 68 that effectively removes ink 114, and contaminant 80, from the surface 68 and ink jet orifice 63. Many potential geometric arrangements are possible, and the actual arrangement selected for use in an embodiment of the present invention is dependent upon the physical characteristics of the cleaning fluid 134, surface 68, and contaminant 80, the rheology of the ink 114 and the cleaning fluid 134, the number of ink jet orifices 63, cleaning orifices, 65 and drain orifices 67 and the relative orientation of the orifices 63, 65, and 67.

FIGS. 8, 9, 10, 11 and 12 depict possible arrangements. These figures are offered to help demonstrate just a few of the many possible combinations of elements consistent with the present invention. It will be understood that for each of the embodiments shown in FIGS. 8, 9, 10 and 11, said flow guides can be optionally defined on said cleaning member, with said cleaning member advancing the flow guides to engage the surface as shown.

Figure 8:
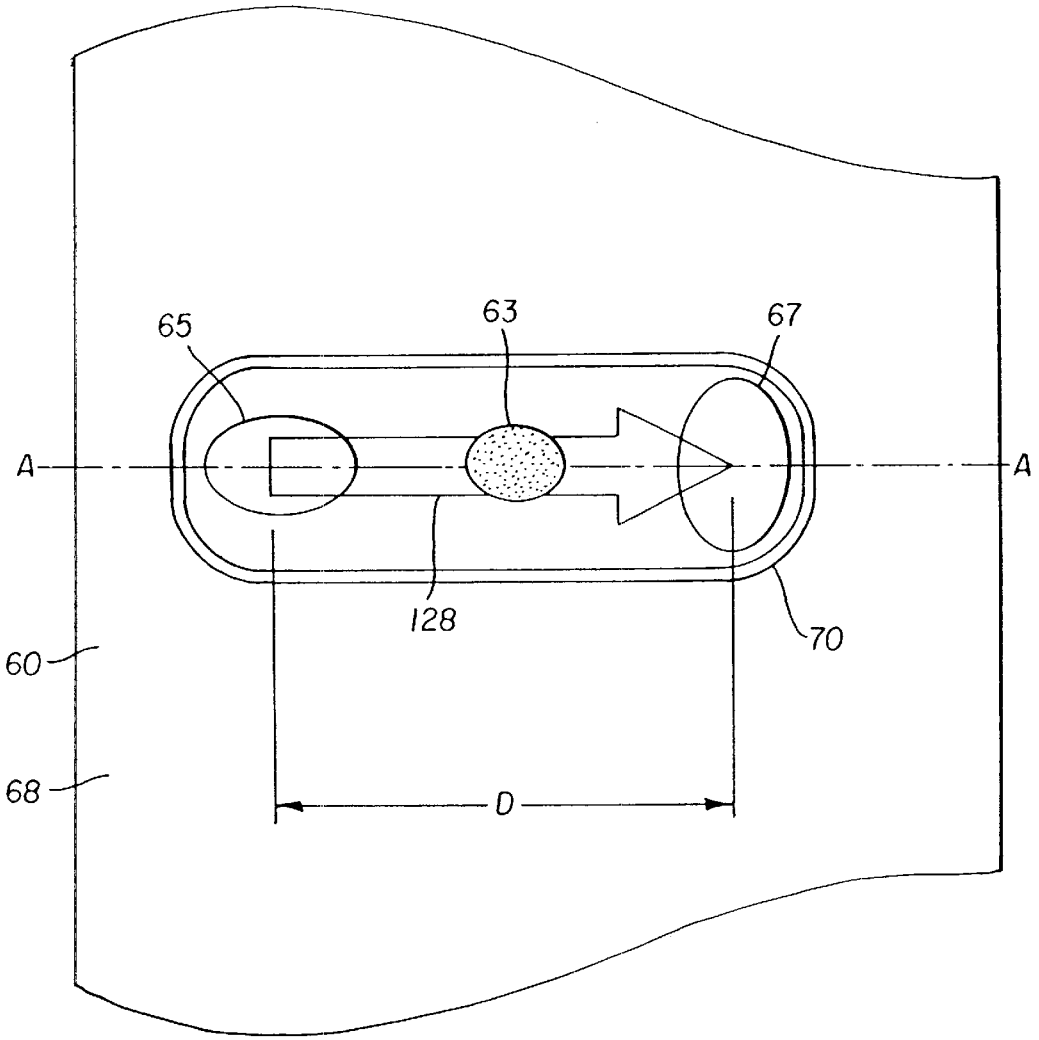
FIG. 8 shows a partial view of an embodiment of the outer surface of the orifice plate of the present invention having an ink jet orifice, cleaning orifice, drain orifice and flow guide.

FIG. 8 shows a view of an outer surface 68 of an orifice plate 60 defining one embodiment of a geometric relationship between a single cleaning orifice 65, a single drain orifice 67, flow guides 70, and the ink jet orifice 63. In this simple embodiment, cleaning orifice 65, ink jet orifice 63, and drain orifice 67, are shown arrayed on a single axis A—A. Flow guides 70 surround orifices 63, 65, and 67 and defines a fluid flow path to confine the flow 128 of cleaning fluid 134 between cleaning orifice 65 and drain orifice 67.

The separation between the cleaning and drain orifices 65 and 68, shown as D, in FIG. 8 will vary with printing conditions, media selection, the size and relative disposition of the ink jet orifices 63 on the outer surface 68 and the rheology of the ink 114 and cleaning fluid 134 used to clean the print head. For example, to implement the present invention to clean ink jet orifices and associated surfaces on a 300 dpi (dots per inch) print head, the separation, D, can be defined at any distance within a range between 50 micrometers and 10,000 micrometers. However, the preferred range of separation is between 200 micrometers and 1000 micrometers.

Figure 9:
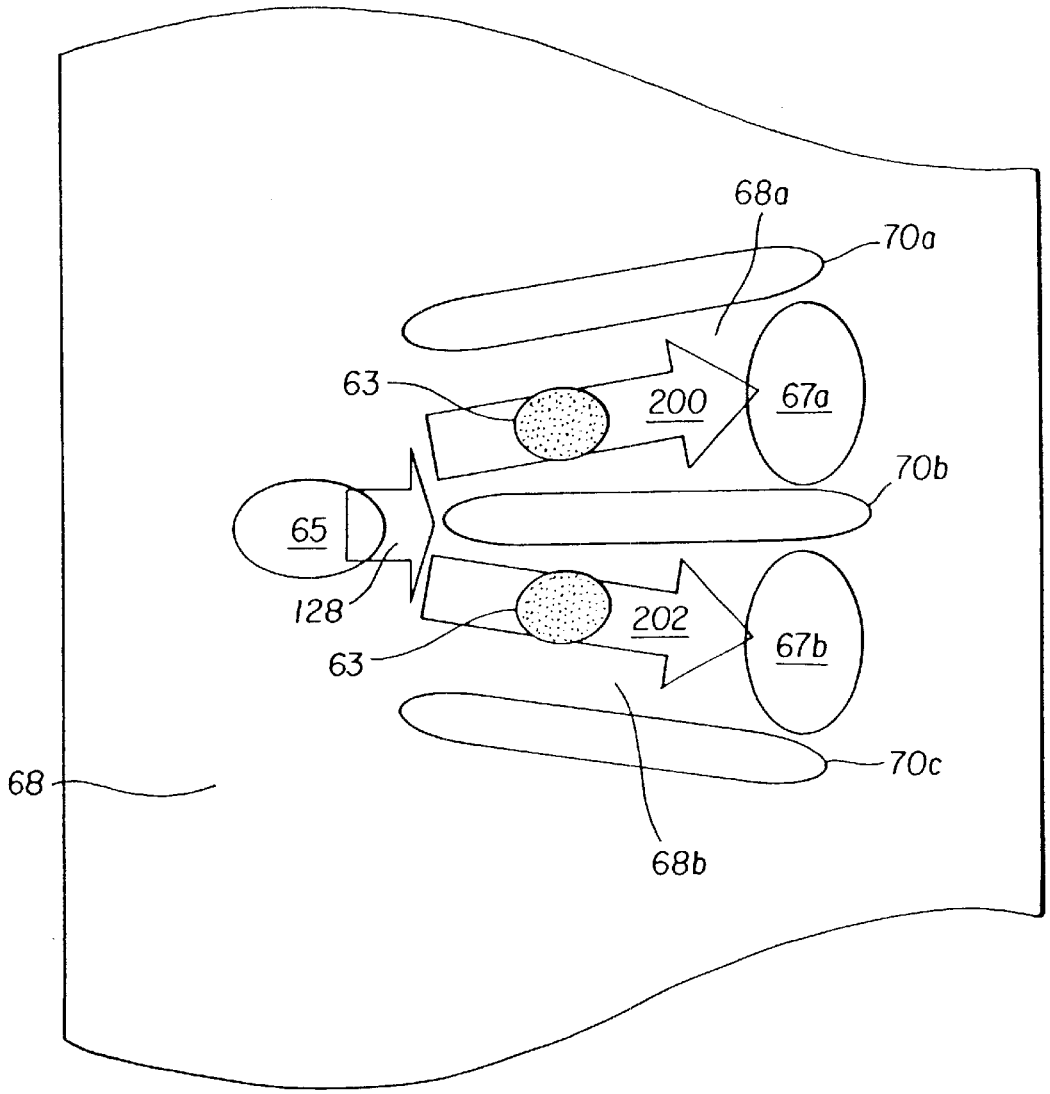
FIG. 9 shows a partial view of an alternative embodiment of the orifice plate of the present invention having a cleaning orifice, a plurality of ink jet orifices, drain orifices and flow guides.

FIG. 9 shows a partial view of outer surface 68 of an orifice plate 60 depicting another embodiment of the present invention. In this embodiment, a single cleaning orifice 65, defines a flow of cleaning fluid 128 that is split by flow guide 70*b* into flows 200 and 202. Flow guides 70*a* and 70*b* guide flow 200 to clean ink jet orifice 63 and surface 68*a* and to flow into drain orifice 67*a,* while flow guides 70*b* and 70*c* guide flow 202 to clean ink jet orifice 63 and surface 68*a* and to flow into drain orifice 67*b.*

It will of course be understood that the elements of the orifice plate 60 can be recombined in any number of arrangements to accommodate any number of ink jet orifices 63, any number of cleaning orifices 65 and any number drain orifices 67.

Figure 10:
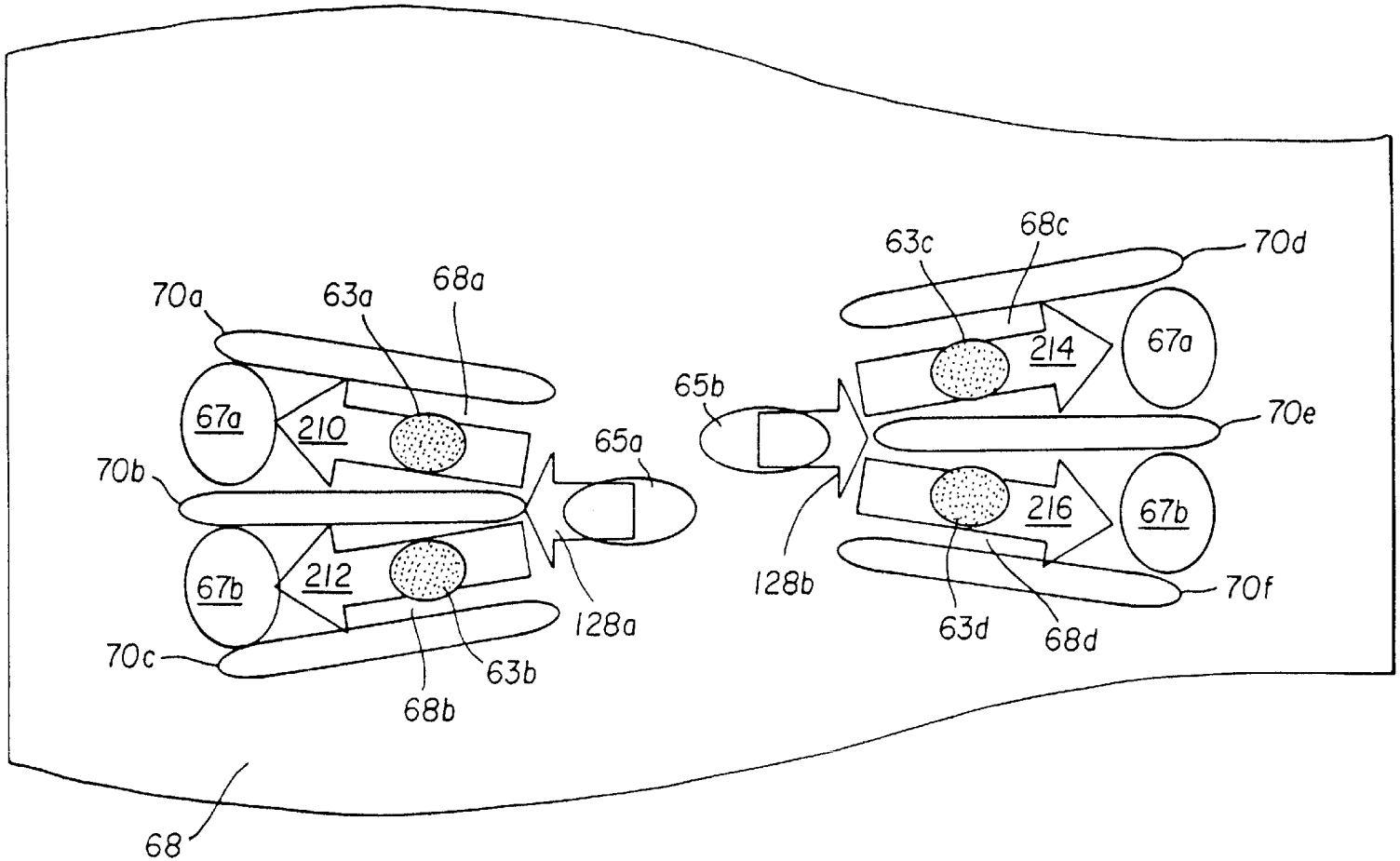
FIG. 10 shows a partial view of an alternative embodiment of the orifice plate of the present invention having a plurality of cleaning orifices, drain orifices and flow guides.

For example, in FIG. 10, there is shown an embodiment for cleaning a two dimensional array of for ink jet orifices 63*a,* 63*b,* 63*c,* and 63*d* using two cleaning orifices 65*a* and 65*b,* four drain orifices 67*a,* 67*b,* 67*c,* and 67*d,* and six flow guides 70*a,* 70*b,* 70*c,* 70*d,* 70*e,* and 70*f.* In this embodiment, a cleaning orifice 65*a,* defines a flow 128*a* of cleaning fluid 134 that is split by flow guide 70*b* into flows 210 and 212. Flow guides 70*a* and 70*b* guide flow 210 to clean ink jet orifice 63*a* and surface 68*a* and to flow into drain orifice 67*a,* while flow guides 70*b* and 70*c* guide flow 212 to clean ink jet orifice 63*b* and surface 68*b* and to flow into drain orifice 67*b.* Cleaning orifice 65*b,* defines a flow 128*b* of cleaning fluid 132 that is split by flow guide 70*e* into flows 214 and 216. Flow guides 70*d* and 70*e* guide flow 214 to clean ink jet orifice 63*c* and surface 68*c* and to flow into drain orifice 67*c,* while flow guides 70*e* and 70*f* guide flow 216 to clean ink jet orifice 63*d* and surface 68*d* and to flow into drain orifice 67*d.*

Figure 11A:
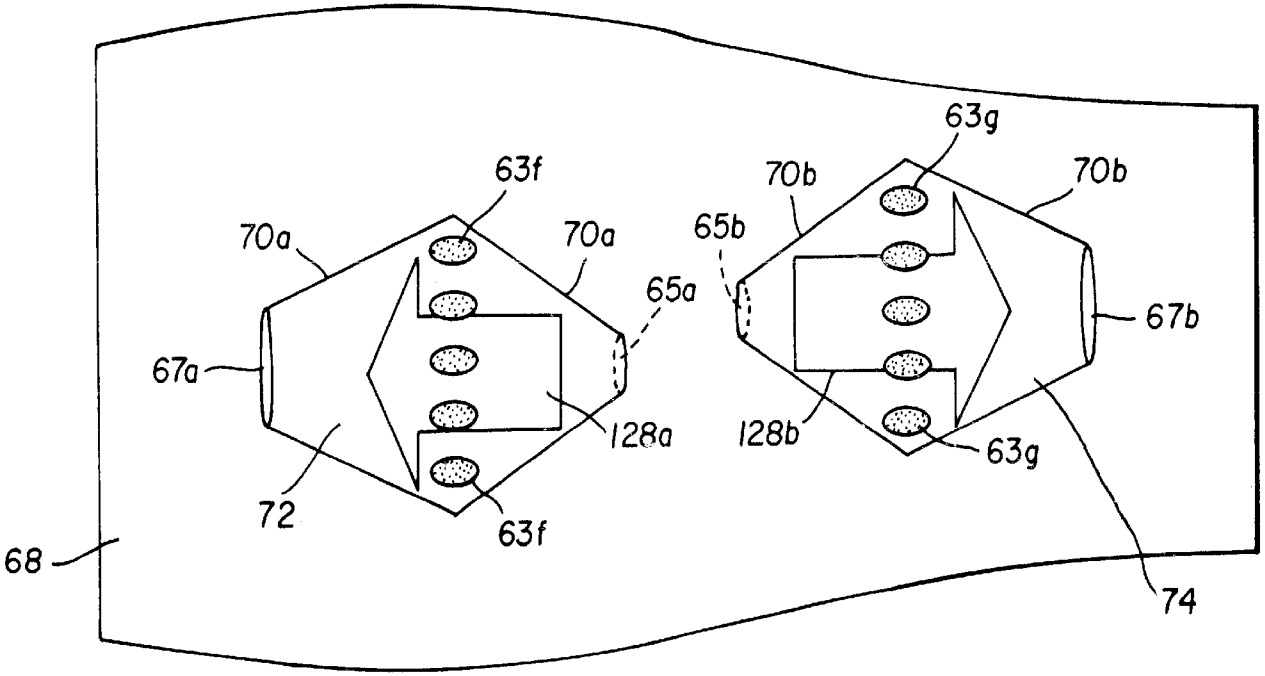
FIGS. 11*a* and 11*b* show an alternative embodiment of the orifice plate of the present invention wherein the flow guides define a trough arrangement.
Figure 11B:
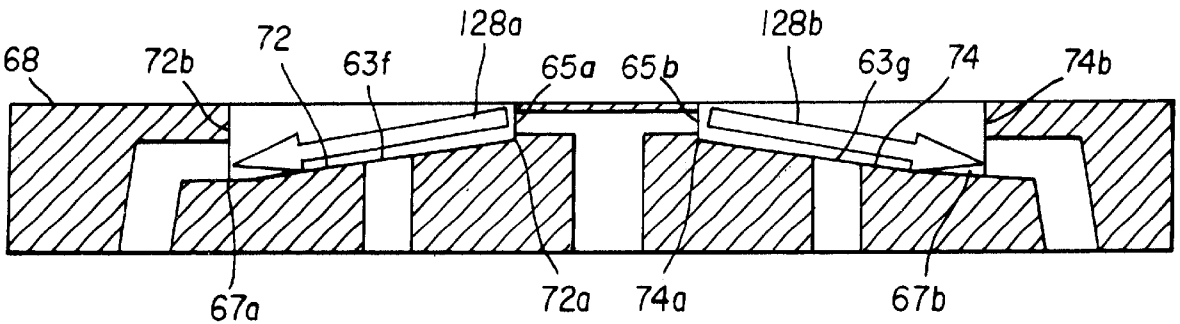

FIG. 11*a* shows an alternative embodiment of the present invention, wherein the cleaning orifices 65*a* and 65*b,* drain orifice 67*a* and 67*b* and arrays of ink jet orifices 63 and 63*f* are located within recesses 72 and 74 of surface 68. As is shown in FIG. 11*b,* which depicts outer surface 68 in partial cross section, flow guides 70 are not defined as projections above outer surface 68, but rather are the sides of recesses 72 and 74 defined in the orifice plate. In this embodiment, arrays of ink jet orifices 63*f* and 63*g* are defined on surfaces 72 and 74 while cleaning orifices 65*a* and 65*b* are defined in the flow guides 72*a* and 74*a* respectively and drain orifices 67*a* and 67*b* are defined at flow guides 72*b* and 74*b* respectively. The flow 128*a* and 128*b* of cleaning fluid is defined along surfaces 72 and 74 and contained within flow guides 70*a* and 70*b*. This embodiment also protects the array orifices 63*f* and 63*g* from damage due to incidental contact with objects in the printer 20.

Figure 12A:
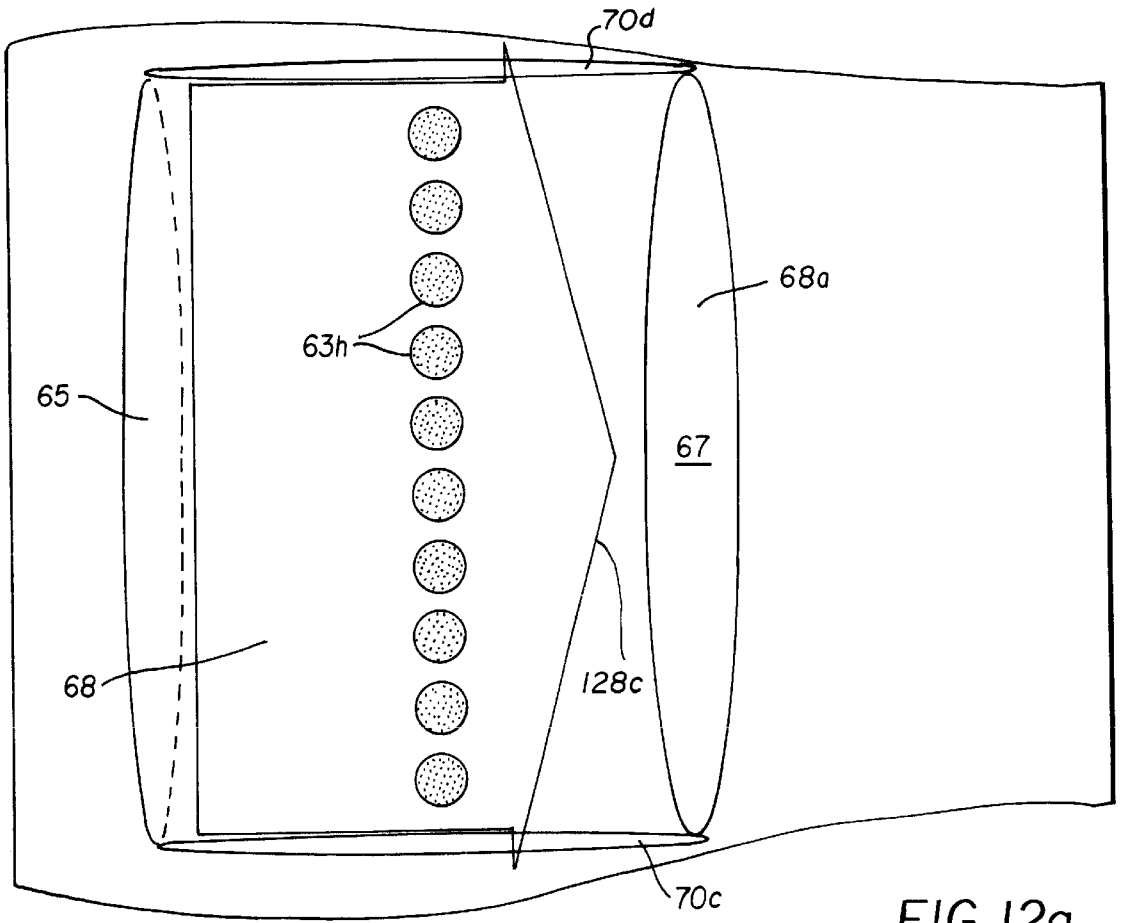
FIGS. 12*a* and 12*b* show other possible embodiments of the present invention wherein an array of ten ink jet orifices are cleaned by a flow of fluid between one cleaning fluid orifice and one drain orifice.
Figure 12B:
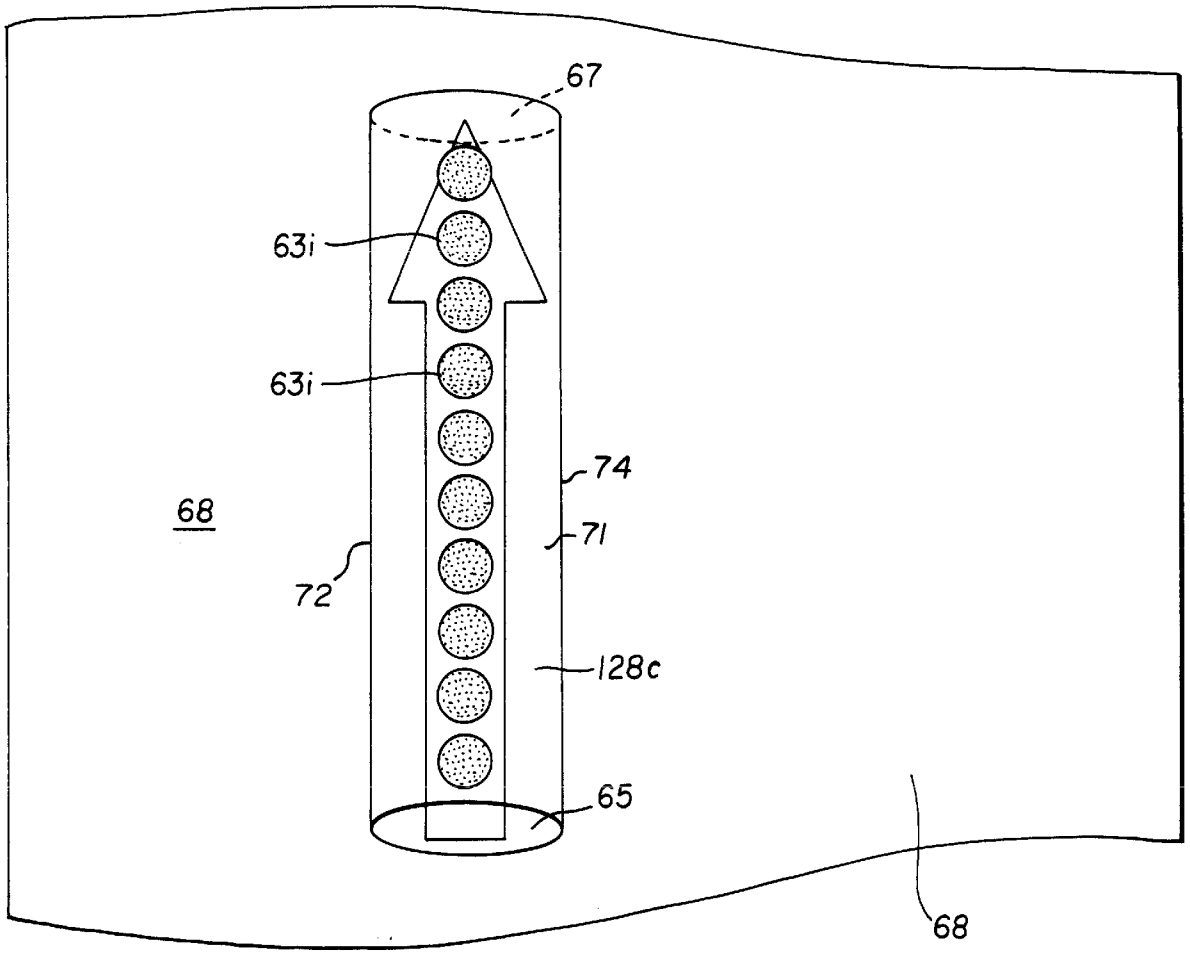

FIGS. 12*a* and 12*b* show other possible embodiments of the present invention wherein an array of ten ink jet orifices 63*h* are cleaned by a flow of fluid from one cleaning orifice 65 and into one drain orifice 67. As is shown in FIG. 12*a,* cleaning fluid orifice is sized to define a flow 128*c* of cleaning fluid 134 across an area of outer surface 68 that includes each ink jet orifices 63*h*. In turn, drain orifice 68 is sized to receive the flow 128*c* of cleaning fluid 134 that flows across such an area. Flow guides 70*c* and 70*d* are optionally provided to confine the flow 128*c* of cleaning fluid 134 across the outer surface 68. Alternatively, a gutter (not shown) can be defined in outer surface 68 between the cleaning orifice 65 and the drain orifice 67, with the gutter acting as a flow guide.

FIG. 12*b* shows another possible arrangement of the orifices on the orifice plate 60 wherein an array of ten ink jet orifices 63*i* are serviced by one cleaning orifice 65 and one drain orifice 67. In this embodiment the ink jet orifices are arranged in a linear manner with drain orifice 67 positioned at one end of the array and cleaning orifice 65 positioned at the opposite end. The flow 128 of cleaning fluid 134 cleans the array of ink jet orifices 63*i.* It will be understood that this embodiment can be used in conjunction with either flow guides (not shown) or a gutter, 71, having sidewalls 72 and 74.

Figure 13:
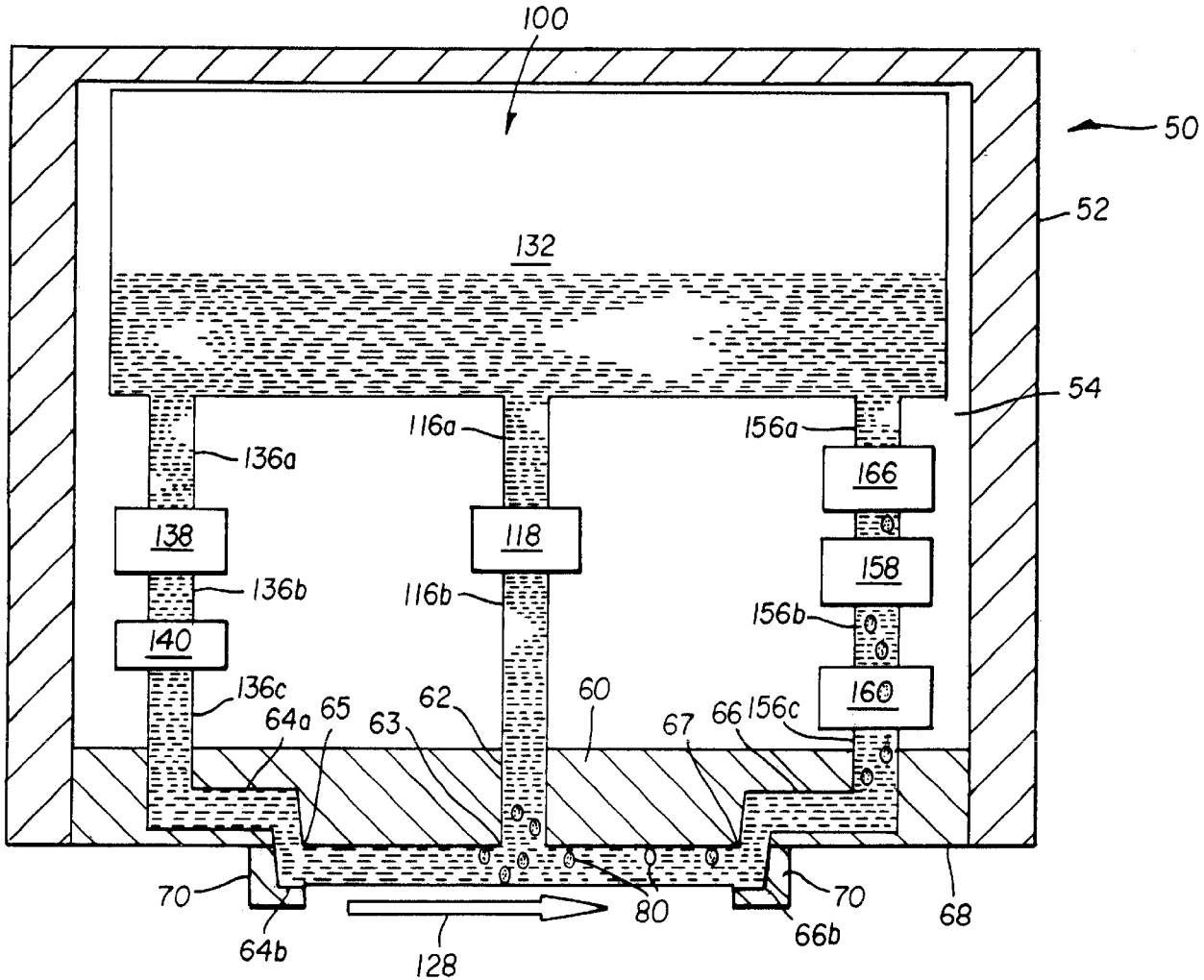
FIG. 13 shows a partial cross section of an embodiment of the present invention wherein the print head comprises integral flow guides defining the cleaning fluid orifice, the drain orifice and portions of the cleaning fluid and drain passage ways wherein ink is used as a cleaning fluid.

As is also shown in FIG. 13, fluid flow guides 70 can be formed as a part of orifice plate 60. In this embodiment, fluid flow guides 70 are shown having a cleaning fluid passageway 64*b* connected to cleaning fluid passageway 64*a* and as also having a cleaning orifice 65. In this way, a flow 128 of cleaning fluid 128 can be defined across outer surface 68 and nozzle 63 from an elevated position relative to outer surface 68. Further, cleaning orifice 65 can more easily be shaped to define a flow 128 of cleaning fluid 134 or ink 114 used as a cleaning fluid along the outer surface 68 of orifice plate 60. In one embodiment, the flow guides 70 are directed so that the flow 128 reflects from outer surface 68. Further, as is shown in FIG. 13, drain orifice 67 can also be formed in flow guide 70 having a drain passageway 66*b* leading to drain passageway 66*a*. It will be understood that flow guide 70 can contain any number of surface features to help guide cleaning fluid 134 and contaminant 80 into the drain orifices 67.

Figure 14:
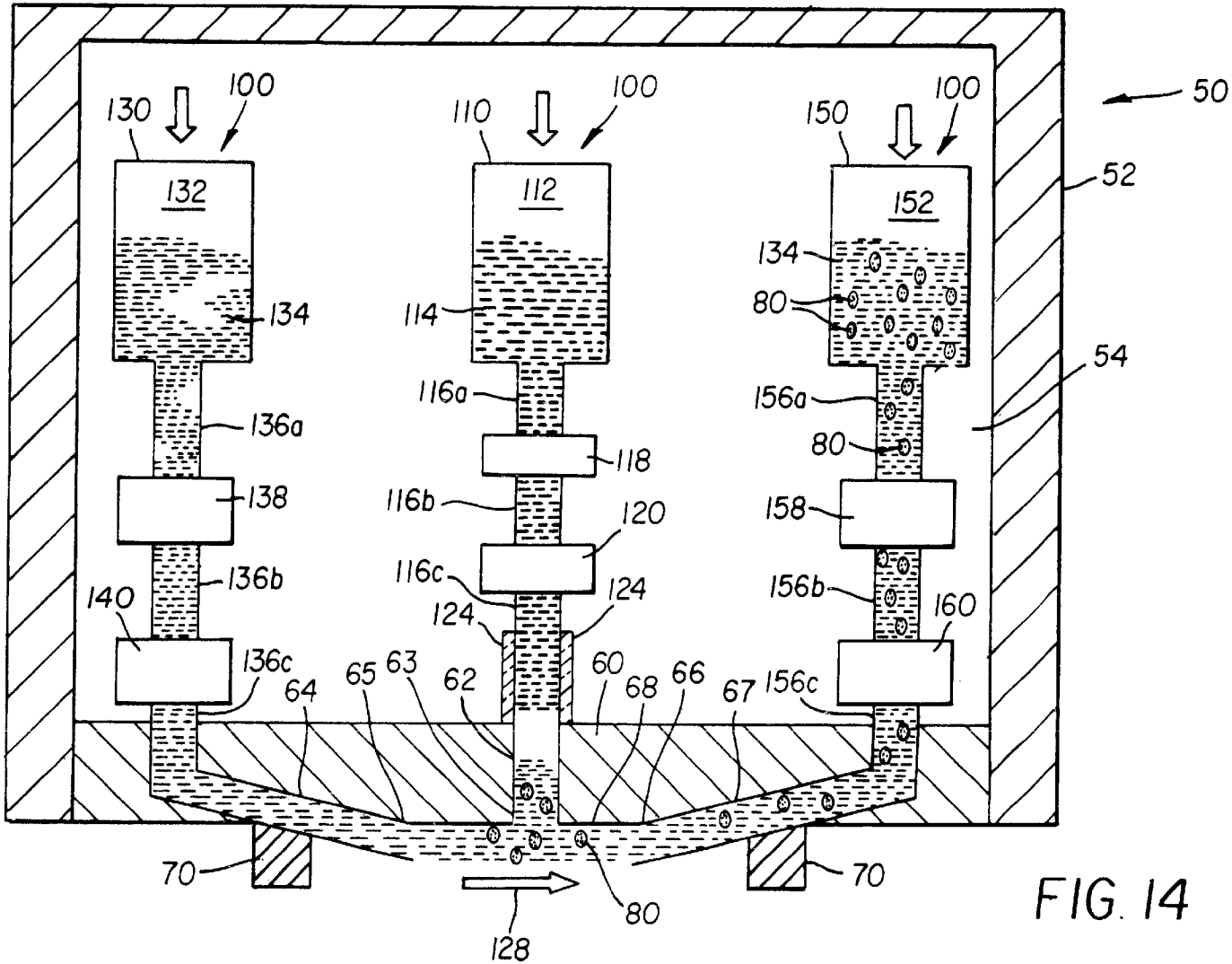
FIG. 14 shows, in a partial cross section, an alternate embodiment of the print head of the present invention wherein the cleaning fluid passageway and cleaning fluid orifice, drain orifice and drain passageway project above the outer surface.

FIG. 14 shows, in a partial cross section, an alternate embodiment of the print head 50 of the present invention wherein cleaning fluid passageway 64 and cleaning orifice 65 project from surface 68. This provides greater flexibility in defining a flow 128 of cleaning fluid 134 across surface 68 and ink jet orifice 63. As is also shown in the embodiment of FIG. 14, drain orifice 67 and drain passageway 66 can also be defined to project above surface 68 to facilitate the application and removal of cleaning fluid 134 from the surface 68.

Figure 15A:
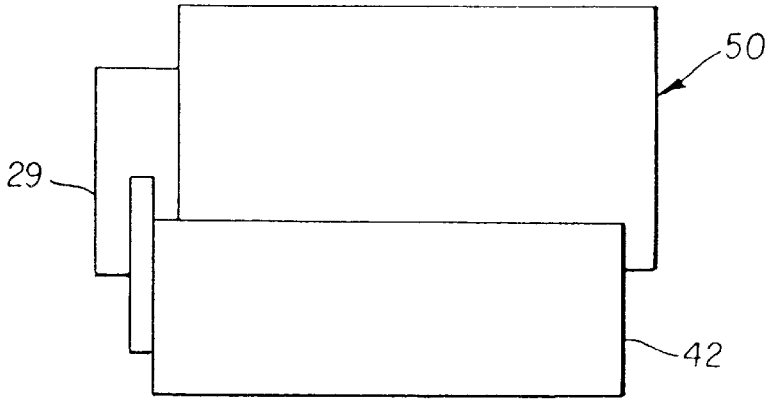
FIG. 15 shows an embodiment of the print head of the present invention with an attached splash guard, actuator and optional ultrasonic transducer.
Figure 15B:
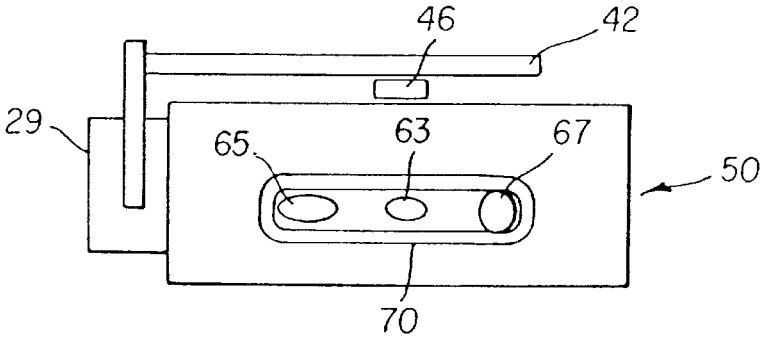
Figure 15C:
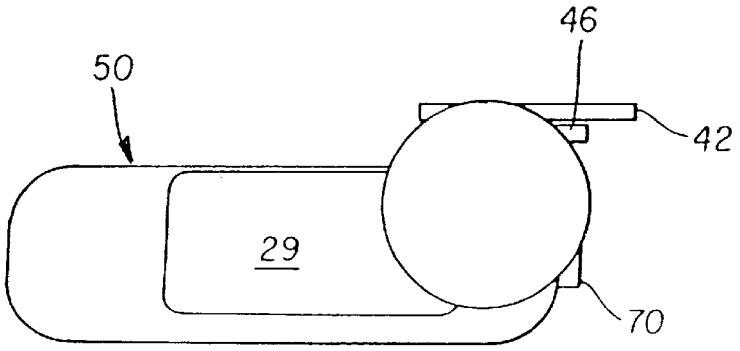

With respect to FIG. 15, what is shown is a top view (FIG. 15*a*), front view (FIG. 15*b*) and side view (FIG. 15*c*) of print head 50 of the present invention having an optional splash guard 42 and actuator 29 fixed to the print head body 54. As is shown in FIGS. 15*a,* 15*b* and 15*c,* splash guard 42 is retracted during printing operations to a position wherein the splash guard 42 does not interfere with the potential flow of ink droplets 58 from the ink jet orifice 63.

Figure 16A:
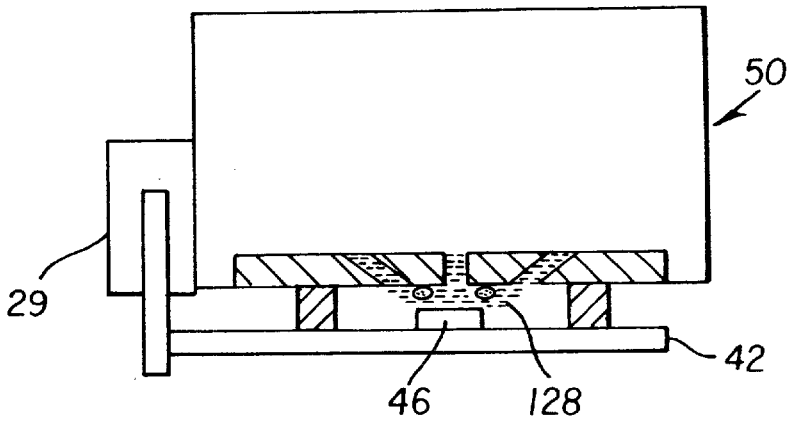
FIG. 16 shows an embodiment of the print head of the present invention having a splash guard, an actuator and an optional ultrasonic transducer wherein the print head comprises a single fluid reservoir and a filter.
Figure 16B:
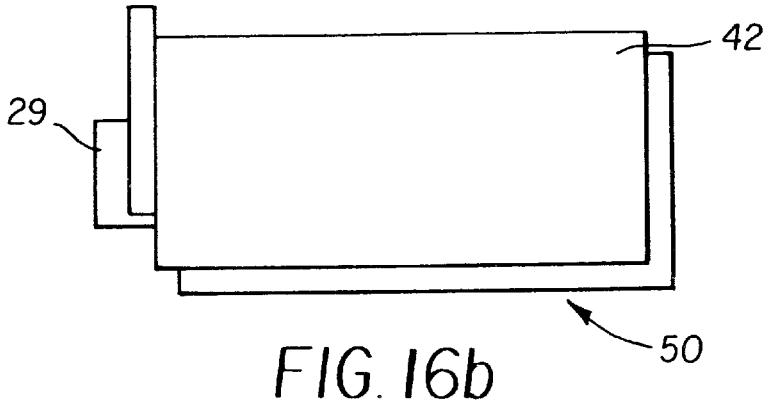
Figure 16C:
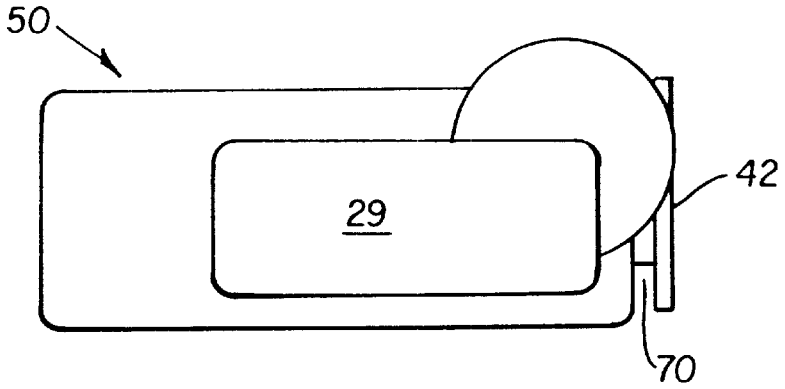

With respect to FIGS. 16*a,* 16*b,* and 16*c,* what is shown is, respectively, top, front and side view of print head 50 of the present invention with splash guard 42 and actuator 29 fixed to print head body 54. In this embodiment, splash guard 42 is advanced by actuator 29 against flow guides 70 forming a seal. A flow 128 of cleaning fluid 134 is defined between cleaning orifice 65 and drain orifice 63. As is also shown in FIG. 16, an ultrasonic transducer 46 can be fixed to splash guard 42 in order to ultrasonically excite the flow 128 of cleaning fluid 134 to enhance the cleaning of the print head orifice 63 and surface 68.

It will be recognized that that the cleaning fluid passageway 66, drain fluid passageway 68 and ink fluid passageway 64 have been shown passing thought the orifice plate 60 at various angles relative to surfaces 61 and 68. It will be recognized that, consistent with the principles of the present invention, the passageways 62, 64 and 66 can take an angular, curved or straight paths between surface 61 and surface 68 as may be dictated by the machining, fabrication, rheology or cost considerations.

It will also be recognized that while the principles of the present invention have been described in association with a print head 50 having a supply of pressurized ink 110 that generates ink droplets 58 using a channel 116*b* or 116*c* that can be squeezed by piezoelectric material 124, the application of this invention is not limited to print heads of this design. In particular, it is understood that one skilled in the art can readily adapt this invention to clean print heads that generate ink droplets of other "on-demand" types such as the thermal "on-demand" type and the continuous type.

It will further be recognized that while ink jet orifice 63 has been shown in the drawings as having a diameter that is the same size as the ink jet passageway 62, in practice, the diameter of the ink jet orifice 63 may be smaller than the diameter of the ink jet passageway 62.

An important advantage of the present invention is that the cleaning orifice 65, cleaning fluid passageway 64, drain orifice 67 and drain fluid passageway 66 can be fabricated at little marginal cost. This is because the processes that are used to define the ink jet orifice 63 and ink jet passageway 62 can effectively be used to define these structures. For example, where a laser is used to fabricate the ink jet orifice 63 and ink jet passageway 62 of a print head 50, it is a relatively inexpensive matter to use the same laser process to define additional orifices and passageways of the type described herein. Similarly, where a molding process is used to form orifice plate 60 then the additional orifices and passageways can be formed at little additional cost using techniques known in the molding arts. It will be appreciated that there are other cost effective techniques known in the art for forming an orifice plate, for example, deep reactive ion etching of silicon substrates, stamping, or electroforming The invention has been described in detail with particular reference to certain preferred embodiments thereof, but it will be understood that variations and modifications can be effected within the spirit and scope of the invention.

PARTS LIST

| | |
|---|---|
| 20 | Printer |
| 22 | Print Head Advance |
| 24 | Controller |
| 26 | Media Advance |
| 27 | Motor |
| 28 | Pinch Roller |
| 29 | Actuator |
| 30 | Printing Area |
| 32 | Image |
| 34 | Media |
| 40 | Cleaning Area |
| 42 | Splash Guard |
| 46 | Ultrasonic Transducer |
| 48 | Sealed Gap |
| 50 | Print Head |
| 52 | Print Head Body |
| 54 | Interior Chamber |
| 56 | Opening |
| 58 | Ink Droplets |
| 60 | Orifice Plate |
| 61 | Fluid Containment Surface |
| 62 | Ink Jet Passageway |
| 63 | Ink Jet Orifice |
| 64 | Cleaning Fluid Passageway |
| 65 | Cleaning Fluid Orifice |
| 66 | Drain Passageway |
| 67 | Drain Orifice |
| 68 | Outer surface |
| 70 | Flow Guide(s) |
| 72 | Flow Guide Side Wall |
| 73 | Flow Guide Surface |
| 74 | Flow Guide Side Wall |
| 75 | Flow Guide Top Surface |
| 80 | Contaminant |
| 100 | Fluid Flow System |
| 110 | Supply of Pressurized Ink |
| 112 | Ink Reservoir |
| 114 | Ink |
| 116 | Ink Fluid Flow Path |
| 118 | Ink Pump |
| 120 | Ink Valve |
| 124 | Sidewalls |

-continued

PARTS LIST

| | |
|---|---|
| 128 | Cleaning Fluid Flow |
| 130 | Supply of Pressurized Cleaning Fluid |
| 132 | Cleaning Fluid Reservoir |
| 134 | Cleaning Fluid |
| 136 | Cleaning Fluid Flow Path |
| 138 | Cleaning Fluid Pump |
| 140 | Cleaning Fluid Valve |
| 144 | Ultrasonic Transducer |
| 150 | Drain Fluid Return |
| 152 | Drain Fluid Reservoir |
| 154 | Drain Fluid Flow Path |
| 156 | Drain Fluid Flow Path |
| 158 | Drain Fluid Pump |
| 160 | Drain Fluid Valve |
| Filter | |

What is claimed is:

1. A self-cleaning printer, comprising:

a print head having an orifice plate defining an ink jet orifice, cleaning orifice and drain orifice and further defining an outer surface between the orifices;

a supply of pressurized cleaning fluid connected to the cleaning orifice; and a fluid return having a drain pump connected to the drain orifice;

wherein, during cleaning operations, the source of pressurized cleaning fluid causes cleaning fluid to flow from the cleaning orifice across the outer surface and the ink jet orifice and the drain pump creates a negative pressure that draws the cleaning fluid into the drain orifice.

2. The self-cleaning printer of claim 1, further comprising a flow guide on the outer surface.

3. The self-cleaning printer of claim 2 wherein said flow guide is defined on the outer surface and wherein said printer further comprises a splash guard movably disposed between a printing position that is removed from the flow guide and a cleaning position engaging the flow guide.

4. The self-cleaning printer of claim 1, wherein the print head further comprises an orifice plate defining more than one ink jet orifice and wherein the print head further comprises more than one flow guide with the flow guides arranged to guide at least a portion of the flow of cleaning fluid across each ink jet orifice.

5. The self-cleaning printer of claim 1 further comprising a supply of pressurized ink and an ink fluid flow path defined between said supply of pressurized ink and said ink jet orifice wherein the cleaning fluid orifice defines a flow of cleaning fluid across the ink jet orifice so as to cause a flow of cleaning fluid to enter ink jet passageway in order to remove any ink or contaminant from ink jet passageway, ink jet orifice, or the ink fluid flow path.

6. The self-cleaning printer of claim 5, further comprising a cleaning fluid vacuum connected to said ink fluid flow path to draw cleaning fluid into said ink fluid flow path during cleaning operations.

7. A self-cleaning printer, comprising:

a print head having an orifice plate defining more than one ink jet orifice, more than one cleaning orifice and more than one drain orifice and further defining an outer surface between the orifices;

a supply of pressurized cleaning fluid connected to the cleaning orifice; and a fluid return connected to the drain orifice;

wherein, during cleaning operations, the source of pressurized cleaning fluid causes cleaning fluid to flow from the cleaning orifice, and the cleaning orifice directs the flow of cleaning fluid across the outer surface and the ink jet orifice and into the drain orifice; and wherein a patterned array of flow guides is disposed on the outer surface to cause at least a portion of the flow of cleaning fluid from the cleaning fluid orifices to flow across the outer surface, across each of the ink jet orifices, and into the drain orifices.

8. A self-cleaning printer, comprising:

a print head having an orifice plate defining an ink jet orifice, cleaning orifice and drain orifice and further defining an outer surface between the orifices;

a supply of pressurized cleaning fluid connected to the cleaning orifice; and a fluid return connected to the drain orifice;

wherein, during cleaning operations, the source of pressurized cleaning fluid causes cleaning fluid to flow from the cleaning orifice, and the cleaning orifice directs the flow of cleaning fluid across the outer surface and the ink jet orifice and into the drain orifice; and wherein a recess is defined in the outer surface with the ink jet orifice defined in the recess, and the recess having two pairs of opposing sidewalls joining the recess to the outer surface and wherein the cleaning orifice and drain orifice are defined through one pair of opposing side walls and a pair of flow guides are defined by the other pair of opposing side walls.

9. A self-cleaning printer, comprising:

a print head having an orifice plate defining an ink jet orifice, cleaning orifice and drain orifice and further defining an outer surface between the orifices said outer surface further comprising a flow guide projecting above the outer surface;

a supply of pressurized cleaning fluid connected to the cleaning orifice;

a fluid return connected to the drain orifice; and a splash guard having an ultrasonic transducer, said splash guard movable between a printing position that is removed from the flow guide and a cleaning position engaging the flow guide.

10. A self-cleaning printer, comprising:

a print head having an orifice plate defining an ink jet orifice, cleaning orifice and drain orifice and further defining an outer surface between the orifices;

a supply of pressurized cleaning fluid connected to the cleaning orifice; and a fluid return connected to the drain orifice;

wherein, during cleaning operations, the source of pressurized cleaning fluid causes cleaning fluid to flow from the cleaning orifice, and the cleaning orifice directs the flow of cleaning fluid across the outer surface and the ink jet orifice and into the drain orifice; and wherein the orifice plate defines a flow guide that projects away from the outer surface and said cleaning orifice and said drain orifice are defined through said projecting flow guide.

11. A self-cleaning print head, comprising:

a print head having an orifice plate defining an ink jet orifice, cleaning orifice and drain orifice and further defining an outer surface between the orifices;

a supply of pressurized cleaning fluid connected to the cleaning orifice; and a fluid return having a drain pump connected to the drain orifice;

wherein, during cleaning operations, the supply of pressurized cleaning fluid causes cleaning fluid to flow from the cleaning orifice, and the drain pump creates a negative pressure that draws the flow of cleaning fluid across the outer surface and the ink jet orifice and into the drain orifice.

12. The self-cleaning print head of claim 11, further comprising a flow guide on the outer surface.

13. The self-cleaning print head of claim 12 further comprising a splash guard movably disposed between a printing position that is removed from the flow guides and a cleaning position engaging the flow guides.

14. The self-cleaning print head of claim 11 further comprising a supply of pressurized ink and an ink fluid flow path defined between said supply of pressurized ink and said ink jet orifice wherein said cleaning fluid orifice defines a flow of cleaning fluid across the ink jet orifice so as to cause a flow of cleaning fluid to enter the ink jet passageway in order to remove any ink or contaminant from ink jet passageway, ink jet orifice, or the ink fluid flow path.

15. The self-cleaning print head of claim 14, further comprising a cleaning fluid vacuum connected to said ink fluid flow path to draw cleaning fluid into said ink fluid flow path during cleaning operations.

16. A self-cleaning print head, comprising:

a print head having an orifice plate defining an ink jet orifice, cleaning orifice and drain orifice and further defining an outer surface between the orifices;

a supply of pressurized cleaning fluid connected to the cleaning orifice; and a fluid return connected to the drain orifice;

wherein, during cleaning operations, the supply of pressurized cleaning fluid causes cleaning fluid to flow from the cleaning orifice, and the cleaning orifice directs the flow of cleaning fluid across the outer surface and the ink jet orifice and into the drain orifice; and wherein said outer surface further comprises a groove defining a flow guide.

17. A self-cleaning print head, comprising:

a print head having an orifice plate defining more than one ink jet orifice, more than one cleaning orifice and more than one drain orifice and further defining an outer surface between the orifices;

a supply of pressurized cleaning fluid connected to the cleaning orifice; and a fluid return connected to the drain orifice;

wherein, during cleaning operations, the supply of pressurized cleaning fluid causes cleaning fluid to flow from the cleaning orifice, and the cleaning orifice directs the flow of cleaning fluid across the outer surface and the ink jet orifice and into the drain orifice; and wherein the print head further comprises more than one flow guide with the flow guides arranged to guide at least a portion of the flow of cleaning fluid across each ink jet orifice.

18. A self-cleaning print head, comprising:

a print head having an orifice plate defining a plurality of ink jet orifices, a plurality of cleaning orifices and a plurality drain orifice and further defining an outer surface between the orifices;

a supply of pressurized cleaning fluid connected to the cleaning orifice; and a fluid return connected to the drain orifice;

wherein, during cleaning operations, the supply of pressurized cleaning fluid causes cleaning fluid to flow from the cleaning orifice, and the cleaning orifice directs the flow of cleaning fluid across the outer surface and the ink jet orifice and into the drain orifice; and wherein said orifice plate further comprises a patterned array of flow guides disposed on the outer surface to cause cleaning fluid from the cleaning fluid orifices to flow across the outer surface, over each of the ink jet orifices and into the drain orifices.

19. A self-cleaning print head, comprising:

a print head having an orifice plate defining an ink jet orifice, cleaning orifice and drain orifice and further defining an outer surface between the orifices;

a supply of pressurized cleaning fluid connected to the cleaning orifice; and a fluid return connected to the drain orifice;

wherein, during cleaning operations, the supply of pressurized cleaning fluid causes cleaning fluid to flow from the cleaning orifice, and the cleaning orifice directs the flow of cleaning fluid across the outer surface and the ink jet orifice and into the drain orifice; and wherein a recess is defined in the outer surface with the ink jet orifice defined in the recess having two pairs of opposite sidewalls joining the recess to the surface and wherein the cleaning orifice and drain orifice are defined through one pair of opposing side walls and a pair of flow guides are defined by the other pair of side walls.

20. A self-cleaning print head, comprising:

a print head having an orifice plate defining an ink jet orifice, cleaning orifice and drain orifice and further defining an outer surface between the orifices said outer surface further comprising a flow guide projecting above the outer surface;

a supply of pressurized cleaning fluid connected to the cleaning orifice;

a fluid return connected to the drain orifice; and a splash guard having an ultrasonic transducer, said splash guard movable between a printing position that is removed from the flow guide and a cleaning position engaging the flow guide.

21. A method for manufacturing a self-cleaning print head comprising:

providing an orifice plate with an outer surface;

defining at least one ink jet orifice therethrough, at least one cleaning fluid orifice therethrough;

shaping the cleaning fluid orifice to direct a flow of a cleaning fluid onto an outer surface and at least one drain orifice therethrough shaped to receive the flow of the cleaning fluid;

providing an enclosure;

providing a source of pressurized cleaning fluid;

providing a fluid return;

assembling the orifice plate to the cleaning orifice;

sealingly connecting the fluid return to the drain orifice;

sealingly connecting the source of pressurized cleaning fluid to the cleaning orifice and sealingly connecting the drain orifice to the fluid return;

positioning the fluid return and the source of pressurized cleaning fluid inside the enclosure; and fixing the enclosure to the orifice plate.

22. The method of claim 21, further comprising the step of providing a splash guard movably disposed between a printing position that is distant from the flow guides and a cleaning position that is proximate to the print flow guides.

23. The method of claim 22, wherein the step of providing a splash guard further comprises providing an ultrasonic transducer to excite the flow of cleaning fluid.

24. The method of claim 21, further comprising the step of providing a drain pump between the fluid return and the drain orifice, with the drain pump adapted to induce a negative pressure at the drain orifice.

* * * * *